US009192230B2

(12) United States Patent
Clegg et al.

(10) Patent No.: US 9,192,230 B2
(45) Date of Patent: Nov. 24, 2015

(54) FOLDING TABLE

(71) Applicants: Frank Clegg, Fruit Heights, UT (US); Mitch Johnson, South Weber, UT (US)

(72) Inventors: Frank Clegg, Fruit Heights, UT (US); Mitch Johnson, South Weber, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

(21) Appl. No.: 14/283,191

(22) Filed: May 20, 2014

(65) Prior Publication Data

US 2014/0345506 A1 Nov. 27, 2014

Related U.S. Application Data

(60) Provisional application No. 61/825,969, filed on May 21, 2013.

(51) Int. Cl.
*A47B 3/083* (2006.01)
*A47B 3/087* (2006.01)

(52) U.S. Cl.
CPC ..... *A47B 3/087* (2013.01)

(58) Field of Classification Search
CPC ..... A47B 7/02; A47B 43/00; A47B 3/0912; A47B 87/02; A47B 87/0207; A47B 87/0215
USPC ..... 108/167, 168, 129, 131, 132, 172, 130, 108/169, 174, 115, 53.3, 91, 92; 248/188, 248/188.6, 188.1, 439
See application file for complete search history.

(56) References Cited

U.S. PATENT DOCUMENTS

| | | | | |
|---|---|---|---|---|
| 6,199,487 | B1 * | 3/2001 | Coddington | 108/56.1 |
| 6,752,091 | B2 * | 6/2004 | Glover et al. | 108/168 |
| 7,096,799 | B2 | 8/2006 | Strong et al. | |
| 7,278,361 | B2 * | 10/2007 | Zhurong et al. | 108/168 |
| 7,634,969 | B2 * | 12/2009 | Neunzert et al. | 108/132 |
| 7,752,982 | B2 * | 7/2010 | Lin | 108/168 |
| D640,487 | S | 6/2011 | Bennett | |
| 8,042,475 | B2 | 10/2011 | Larcom et al. | |
| 8,166,894 | B1 | 5/2012 | Branch et al. | |
| 8,267,018 | B2 * | 9/2012 | Gunn | 108/53.1 |
| D668,483 | S | 10/2012 | Bennett | |
| 8,397,652 | B2 * | 3/2013 | Peery et al. | 108/91 |

(Continued)

OTHER PUBLICATIONS

International Search Report and Written Opinion from PCT/US2014/039021 dated Sep. 26, 2014.

(Continued)

*Primary Examiner* — Jose V Chen
(74) *Attorney, Agent, or Firm* — Maschoff Brennan

(57) ABSTRACT

A folding table may include a table top and legs that are movable between an extended position and a collapsed position. The table top may be divided into a first section and a second section, and a hinge assembly may connect the first and second sections of the table top to allow the table to be selectively moved between folded and unfolded positions. In addition, a support frame may be connected to the first and second table top sections. The table top may include a downwardly extending lip with one or more engaging portions and receiving portions. The engaging portions may be at least partially disposed within corresponding receiving portions when the table is in the folded position. The engaging portions and receiving portions may be spaced apart when the table is in the unfolded position.

20 Claims, 12 Drawing Sheets

(56) References Cited

U.S. PATENT DOCUMENTS

| | | | | |
|---|---|---|---|---|
| 8,555,789 | B2 | 10/2013 | Jin et al. | |
| 8,555,790 | B2 | 10/2013 | Winter et al. | |
| D700,465 | S | 3/2014 | Johnson et al. | |
| 2005/0005826 | A1* | 1/2005 | Strong et al. | 108/132 |
| 2013/0025507 | A1 | 1/2013 | Jin et al. | |

OTHER PUBLICATIONS

U.S. Appl. No. 61/825,969, filed May 21, 2013, Johnson et al.
U.S. Appl. No. 29/455,545, filed May 21, 2013, Johnson et al.
U.S. Appl. No. 29/455,544, filed May 21, 2013, Johnson et al.
U.S. Appl. No. 29/473,890, filed Nov. 26, 2013, Johnson et al.

* cited by examiner

FOLDING TABLE

CROSS-REFERENCE TO RELATED APPLICATIONS

The present invention claims priority to and the benefit of U.S. Provisional Patent Application Ser. No. 61/825,969, entitled FOLDING TABLE, which was filed on May 21, 2013, and is hereby incorporated by reference in its entirety.

BACKGROUND OF THE INVENTION

1. Field of the Invention

The present invention generally relates to furniture and, in particular, to tables that are capable of being folded and unfolded.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against an underneath portion of the table top. Conventional tables with relatively large table tops and folding legs are often referred to as "banquet tables" and these tables are frequently used in assembly halls, banquet halls, convention centers, hotels, schools, churches and other locations where large groups of people meet. When the tables are no longer needed, the table legs can be moved into the storage position and the tables may be moved or stored.

Conventional banquet tables with movable legs may allow the tables to be more conveniently stored. The table top for many conventional banquet tables with movable legs, however, retains its size and shape. For example, many known banquet tables have a length between six and ten feet and a width between three and four feet. As a result, many conventional banquet tables require a large storage area even when the legs are in the collapsed position. This large storage area may be especially problematic for larger facilities such as hotels, schools and churches because a considerable number of tables may have to be stored. Thus, a significant amount of space may be required to store the tables. In addition, smaller facilities such as restaurants, offices and homes may use one or more banquet tables. These smaller facilities may use the tables less frequently, such as during special occasions. Conventional banquet tables, even when the legs are folded, are often too bulky and awkward to be conveniently used and stored at such smaller facilities. As a result, it is often necessary for both larger and smaller facilities to rent and/or borrow banquet tables when needed. Disadvantageously, this process of renting and/or borrowing banquet tables can be inconvenient, time consuming and costly.

Conventional banquet tables are also often difficult to move or transport from one location to another. For example, because of the length of many conventional banquet tables, it is often difficult for a single person to move the table. In addition, the extended length of conventional banquet tables may preclude the tables from being transported in the trunk or back seat of a typical passenger car. Accordingly, conventional banquet tables may have to be transported by a truck, trailer or oversized vehicle such as a sports utility vehicle. These and other factors may make moving conventional banquet tables troublesome and difficult.

It is also known to construct banquet tables that are capable of being folded in half. A conventional fold-in-half banquet table typically includes a table top with two sections pivotally connected by hinges. The two sections usually have the same size and shape, and the hinges are typically located at the center or middle of the table top. The two sections of the table top may be moved between an unfolded position in which the sections of the table top are generally aligned in the same plane and a folded position in which the two sections are positioned generally adjacent to each other for storage.

Disadvantageously, many conventional fold-in-half banquet tables are unable to support a significant amount of weight. For example, the connection between the two sections of the table top for many known fold-in-half banquet tables is relatively weak, which allow the table top to undesirable sag or slump. Additionally, the connection between the table top sections for many known fold-in-half banquet tables may be relatively frail and may break if a significant load or force is applied to the table top. In order to construct a stronger table, it is known to increase the size and thickness of the frame, but this may undesirably increase the weight and cost of the table.

Another disadvantage of many conventional fold-in-half banquet tables is a large amount of space may be required even when the table is folded. This large amount of space may make the table awkward and difficult to move. The large size of these tables in the folded position may also limit the number of tables that can be stored in a given area.

BRIEF SUMMARY OF EMBODIMENTS OF THE INVENTION

A need therefore exists for a table that eliminates or diminishes the disadvantages and problems described above.

One aspect is a table that may include a table top and one or more support structures or legs that may be used to support the table top in a use position. The support structures may be movable between an extended or use position and a collapsed or storage position relative to the table top. When the support structures are in the use position, the support structures may extend outwardly and away from the table top. When the support structures are in the collapsed position, the support structures may be disposed generally parallel and at least proximate a lower or underneath portion of the table top. At least a portion of the support structures may contact or abut the lower portion of the table top when the support structures are in the collapsed position. Advantageously, when the support structures are in the use position, the table may be used to support a wide variety of objects and the table may be used for many different purposes. When the support structures are in the collapsed position, the table may be more easily moved, stored and/or transported.

Another aspect is a table that may include a table top capable of being folded and unfolded. For example, the table top may include two sections that are generally aligned in the same plane when the table top is in the unfolded position. The two sections of the table top may be positioned generally parallel and adjacent to each other when the table top is in the folded position. The table may also include support structures that are movable between use and collapsed positions. Advantageously, if the table includes both a foldable table top and support structures movable between the use and collapsed positions, the table may be stored in a relatively compact area. This may also allow, for example, a single person to easily move and transport the table. In addition, this may allow the table to be positioned in a relatively small area, such as the backseat or trunk of an automobile. Further, this may allow one or more tables to be shipped and/or stored in relatively small areas, which may allow transportation and storage costs to be decreased.

Still another aspect is a table that may include a table top constructed from plastic and the plastic table top may be constructed using a blow-molding process. Advantageously, the blow-molded plastic table top may be lightweight, easily constructed and readily formed into a desired shape, size, configuration and design. The blow-molded plastic table top may also be generally weather resistant and temperature insensitive, which may allow the table to be used in a wide variety of locations and environments. In addition, the blow-molded plastic table top may be durable, long-lasting and corrosion resistant. Further, the blow-molded plastic table top may be relatively strong and used to support a relatively large amount of weight. Significantly, the blow-molded plastic table top may form a structural member of the table and various features may be integrally formed in the table top as part of a unitary, one-piece construction.

Advantageously, a blow-molded plastic table top may be relatively strong because it may include opposing walls or surfaces separated by a distance. In particular, the opposing walls may be separated by a generally constant distance and the table top may have generally uniform characteristics and/or features, which may help create a table top with generally uniform properties such as strength and structural integrity. In addition, because a hollow interior portion may be formed during the blow-molding process, that may facilitate construction of a lightweight table top. Thus, the blow-molded plastic table top may be both lightweight and strong. The table top could also be formed from other suitable processes, such as injection, rotational, extrusion, vacuum or thermoforming processes, and the table top could be constructed using other appropriate materials such as steel, aluminum, composites and the like.

Yet another aspect is a table that may include a frame attached to the table top. The frame may be sized and configured to allow the table top to be moved between the folded and unfolded positions. For example, the frame may include one or more elongated members, such as rails. In particular, the table may include a plurality of rails, such as side rails, and the rails may be connected to the first and second sections of the table top. The first and second sections of the table top may be connected by one or more hinges. The hinges, for example, may be pivotally connected to the side rail. In particular, a first portion of the side rail may be connected to the first section of the table top and a second portion of the side rail may be connected to the second section of the table top. A hinge may be connected to the first and second portions of the side rail, which may allow a strong and sturdy table top to be constructed.

Still yet another aspect is a table that may include a table top with lip. The lip may extend downwardly and the lip may be integrally formed with the table top as part of a unitary, one-piece structure. The lip may be disposed at least proximate and/or spaced inwardly from an outer edge of the table top. The lip may extend downwardly relative to a lower or underneath portion of the table top. In addition, the lip may extend around all, substantially all or a portion of the table top. The lip may include one or more openings, recesses, cutouts and the like, which may form one or more handles and/or may allow one or more handles to be attached to the table top. Advantageously, the lip may be used to hide or prevent one or more portions of the table from being seen. For instance, the lip may prevent all or a portion of the frame and/or support structures from being exposed and/or seen. The lip may also be sized and configured to allow all or a portion of the frame and/or support structures to be exposed or seen depending, for example, upon the intended use of the table.

A further aspect is a table that may include one or more nesting, interlocking and/or overlapping portions. For example, one or more portions of the table may nest, interlock and/or overlap when the table is in the folded position. The nesting portions may be formed and/or connected to the table top. The nesting portions may also be integrally formed with the table top as part of a unitary, one-piece structure. For instance, the nesting portions may be at least partially formed by at least a portion of the lip. It will be understood that the nesting portions could also be free-standing structures and/or form part of another part, feature or portion of the table. In particular, the nesting portions may be formed by at least a portion of the lip, and the lip and nesting portions may be integrally formed with the table top as part of a unitary, one-piece structure.

Another further aspect is a table that may allow the height or overall thickness of the table to be decreased in the folded position. Preferably the height or thickness of the table in the folded position is significantly decreased, which may allow the table to be stored in a smaller area and allow more tables to be stored in a smaller area. In particular, the table may have generally the same size and configuration as a conventional table, and the table may have generally the same or greater strength and structural integrity as a conventional table, but the table may require significantly less space in the folded position. For example, the table top may include first and second sections, and the table top may include one or more engaging and/or receiving portions. In particular, a first section of the table top may include one or more engaging portions and a second section of the table top may include one or more receiving portions. The engaging portions may be sized and configured to be disposed in corresponding receiving portions when the table is in the folded position. In greater detail, the first section of the table top may include a lip and one or more engaging portions may be disposed in the lip. The second section of the table top may include a lip and one or more receiving portions may be disposed in the lip. When the table top is in the folded position, the engaging portions may be at least partially disposed in the receiving portions. Thus, for instance, the first section of the table top may include a lip with an engaging portion and the second section of the table top may include a lip with a receiving portion, and the engaging and receiving portions may be sized and configured to interact when the table is in the folded position. Specifically, the engaging portions may be disposed in the receiving portions, which may decrease the height of the table in the folded position.

A still further aspect is a table that may include a table top with engaging and receiving portions. One or more of the engaging and/or receiving portions may have generally L-shaped configuration. For example, the table top may include a lip with a generally L-shaped cross-sectional configuration. In particular, the upper portion of the generally L-shaped lip may form the engaging portion and the notch or cutout may form the receiving portion. This may allow, for example, the lip to include first and second portions that are mirror-images of one another. The lip could also include first and second generally L-shaped portions that are disposed in inverted and/or opposing configurations. Preferably, the engaging and receiving portions are disposed such that the engaging portions are at least partially disposed in the receiving portions when the table is in the folded position. In greater detail, the first section of the table top may include a lip with an engaging portion and a receiving portion, and the second section of the table top may include a lip with an engaging portion and a receiving portion. When the table is in the folded position, the engaging portions may be at least partially disposed in the receiving portions. It will be appreciated that the first and section sections of the table top may include an engaging portion, a receiving portion and/or any suitable number or combination of engaging and receiving portions.

Yet another further aspect is a folding table that may be disposed in a more compact configuration in the collapsed position than a conventional folding table. For example, because the strength and rigidity of a table may be directly proportional to the height and width of the side rails of the frame, decreasing the height and/or width of the side rails may undesirably decrease the strength and/or rigidity of the table. Therefore, it may be desirable to maintain the height and width of the side rails so that the frame of the more compact folding table has the same general size, strength and other characteristics as the frame of a conventional folding table. Additionally, if the size of the side rails is decreased, then consumers and retailers may assume the table has less strength and rigidity than a comparable conventional folding table. For these and other reasons, the frame of the more compact folding table may have substantially the same height and width as a conventional folding table. In particular, the frame of the more compact folding table may have generally the same size and configuration as the frame of a conventional folding table. This may allow, for example, the frame of the more compact folding table to have generally the same size, configuration, strength, rigidity and/or cost as the frame of a conventional folding table of the same type and size. In addition, the size of the lip may indicate to consumers and retailers the strength, sturdiness and structural integrity of a table. That is, consumers and retailers may assume a table top with a smaller lip has less strength, sturdiness and structural integrity than a table top with a larger lip. Therefore, it may be advantageous for these and other reasons for the lip of the more compact folding table to have substantially the same height and width as the lip of a conventional folding table.

Advantageously, the lip of the more compact folding table may have at least approximately the same height and width as the lip of a comparable folding table, but the lip may allow the table to be disposed in a more compact configuration. For example, when a conventional folding table is folded, the table has a height at least twice the height of the lip and twice the height of the tale top. Therefore, conventional tables in the folded position have a height equal to the combined height of the lip and table top of the first section of the table top, and the height of the lip and table top of the second section of the table top. The folding table disclosed herein, however, may have generally the same appearance, strength, rigidity and/or other characteristics as a conventional table because the height and width of the lip may be relatively unchanged, but the table may be disposed in a more compact configuration because the lip may include one or more receiving and engaging portions. This may advantageously allow the table to have a decreased overall height or thickness in the folded position because one or more portions of the lips may overlap and/or be nested together.

Still yet another further aspect is a table that may be more efficiently packaged, stored and/or transported. For example, incorporating one or more of the above-described features may advantageously allow about 1,200 tables to be stored in a standard shipping container, while only 1,020 tables that lack such features could be stored in a standard shipping container. Thus, the features described above may allow about seventeen percent (17%) more tables to be shipped in a standard shipping container, which may significantly reduce shipping costs. In another example, a conventional folding table may include first and second sections that have a height of about one and one-half (1.5) inches and the table may have a thickness of at least three (3.0) inches in the folded position. The features described above may allow a more compact folding table to have first and second sections that have a height of about one and one-half (1.5) inches and with similar strength, rigidity and characteristics as a conventional folding table, but a thickness of only about two and one-half (2.5) inches in the folded position. This may allow the thickness of the table in the folded position to be decreased by about seventeen percent (17%) from a similar conventional table. Significantly, this may allow six tables with a thickness of about two and one-half (2.5) inches in the folded position to be disposed in the same space as five tables with a thickness of about three (3.0) inches. This may also allow twenty-four tables including one or more of the features described above to be disposed in the same space as twenty tables with a thickness of about three (3.0) inches. Importantly, the features disclosed above may allow a plurality of tables to be more efficiently stored, stacked, shipped, packaged and/or transported. These features may significantly reduce costs for manufacturers because transportation costs may be decreased. These features may also allow retailers to more efficiently store and display the tables. In addition, these features may allow businesses, consumers and purchasers to save a considerable amount of space when the tables are disposed in the folded or collapsed position Another aspect is a folding table that may include a table top with a first section and a second section, a first support structure movable between an extended position and a collapsed position relative to the first section of the table top, a second support structure movable between an extended position and a collapsed position relative to the second section of the table top, a frame, and a hinge assembly connecting the first and second sections of the table. The first section of the table top may include a lip with one or more engaging portions and the second section of the table top may include a lip with one or more receiving portions. The table may be disposed in an unfolded position in which the engaging portions are spaced apart from the receiving portions. The table may also be disposed in a folded position in which the engaging portions are disposed in the receiving portions, which may allow the height of the frame to be decreased.

Still another aspect is a folding table that may include a table top with first and second sections, first and second support structures movable between an extended position and a collapsed position relative to the table top, a frame, and a hinge assembly connecting the first and second sections of the table. The first section of the table top may include a lip with one or more engaging portions and/or one or more receiving portions. The second section of the table top may include a lip with one or more engaging portions and/or one or more receiving portions. The table may be disposed in an unfolded position in which the engaging portions are spaced apart from corresponding receiving portions. The table may also be disposed in a folded position in which the engaging portions are disposed in corresponding receiving portions, which may allow the height of the frame to be decreased.

Advantageously, the engaging and receiving portions may at least partially, substantially or completely overlap when the table is in the folded position. In addition, the engaging portions may include one or more engagement surfaces that may contact one or more portions of the receiving portions when the table is in the folded position. For example, the engaging portions may include a first engagement surface that is sized and configured to contact a first portion of a receiving portion when the table is in the folded position. The engaging portions may further include a second engagement surface that is sized and configured to contact a second portion of the receiving portion when the table is in the folded position. If desired, the first and second engagement surfaces of the engaging portions may be spaced apart by a distance and/or disposed at an angle. Significantly, the table in the folded position may have a height that is about ten percent (10%) or less than a height of the lip of the first section of the table top, the height of the lip of the second section of the table top, the thickness of the first section of the table top and the thickness of the second section of the table top. The height of the table in the folded position may also be at least about fifteen percent (15%) or less than the height of the lip of the first section of the table top, the height of the lip of the second section of the table top, the thickness of the first section of the table top and the thickness of the second section of the table top. In addition, the height of the table in the folded position may be about twenty percent (20%) or less than the height of the lip of the first section of the table top, the height of the lip of the second section of the table top, the thickness of the first section of the table top and the thickness of the second section of the table top. Additionally, the lip of the first section of the table top and the lip of the second section of the table top may have generally the same size, shape and configuration; may be generally aligned and coplanar; and may have an inverted or reverse position relative to a lower surface of the table top to allow the engaging portion to be disposed in the receiving portion when the table is in the folded position.

Yet another aspect is a table that may include a table top with a structure, such as a lip, with an engaging portion and a receiving portion. For example, a first section of the table top may include a lip with an engaging portion and/or receiving portion and a second section of the table top may include a lip with an engaging portion and/or receiving portion. The engaging and receiving portions are preferably sized and configured such that the engaging portion may be at least substantially disposed in the receiving portion when the table is in a folded position. The lip of the first and second sections of the table top may be generally aligned and coplanar when the table is in the unfolded position. Additionally, the lip may have generally L-shaped configurations and the lip may be sized and configured so that the generally L-shaped lip of the first and second sections of the table top may nest together when the table is in the folded position. Further, the first section of the table top may include an engaging portion and the second section of the table top may include a receiving portion, the engaging portion may be disposed in the receiving portion when the table top is in the folded position, and the engaging portion may be spaced apart from the receiving portion when the frame is in the unfolded position.

Still another aspect is a folding table that may include a table top which rotates about an axis of rotation between folded and unfolded positions, and the axis of rotation may be disposed between an engaging portion and a receiving portion of the lip. The axis of rotation may also be disposed between a first end and a second end of the engaging portion. In addition, the axis of rotation may be disposed between a surface of the engaging portion and a surface of the receiving portion. For example, the lip may include a surface aligned with a portion of the engaging portion and a surface aligned with a portion of the receiving portion, and the axis of rotation may be disposed between these surfaces. In addition, the lip may include a body with an engaging portion and/or a receiving portion. The axis of rotation may also be disposed between the body of the first portion of the lip and the body of the second portion of the lip when the table is in the folded position.

A still further aspect is a folding table that may include a table top with a first section with engaging and/or receiving portions and a second section with engaging and/or receiving portions. The first and second sections of the table top may include an unfolded position in which the first and second sections of the table top are generally aligned and the engaging portions on the first section of the table top are spaced apart from corresponding receiving portions on the second section of the table top. The table top may also include receiving portions on the first section of the table top that are spaced apart from corresponding receiving portions on the second section of the table top. The first and second sections of the table top may also include a folded position in which the engaging portions are disposed in the receiving portions.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is directed towards folding tables. The principles of the present invention, however, are not limited to folding tables. It will be understood that, in light of the present disclosure, the tables disclosed herein can be successfully used in connection with other types of tables, furniture and the like.

Additionally, to assist in the description of the tables, words such as top, bottom, front, rear, right and left may be used to describe the accompanying figures. It will be appreciated that the tables can be disposed in other positions, used in a variety of situations and may perform a number of different functions. In addition, the drawings may be to scale and may illustrate various configurations, arrangements, aspects and features of the table. It will be appreciated, however, that the tables may have other suitable shapes, sizes, configurations and arrangements depending, for example, upon the intended use of the table. Further, the table may include any suitable number or combination of aspects, features and the like. A detailed description of exemplary embodiments of the tables now follows.

Figure 1:
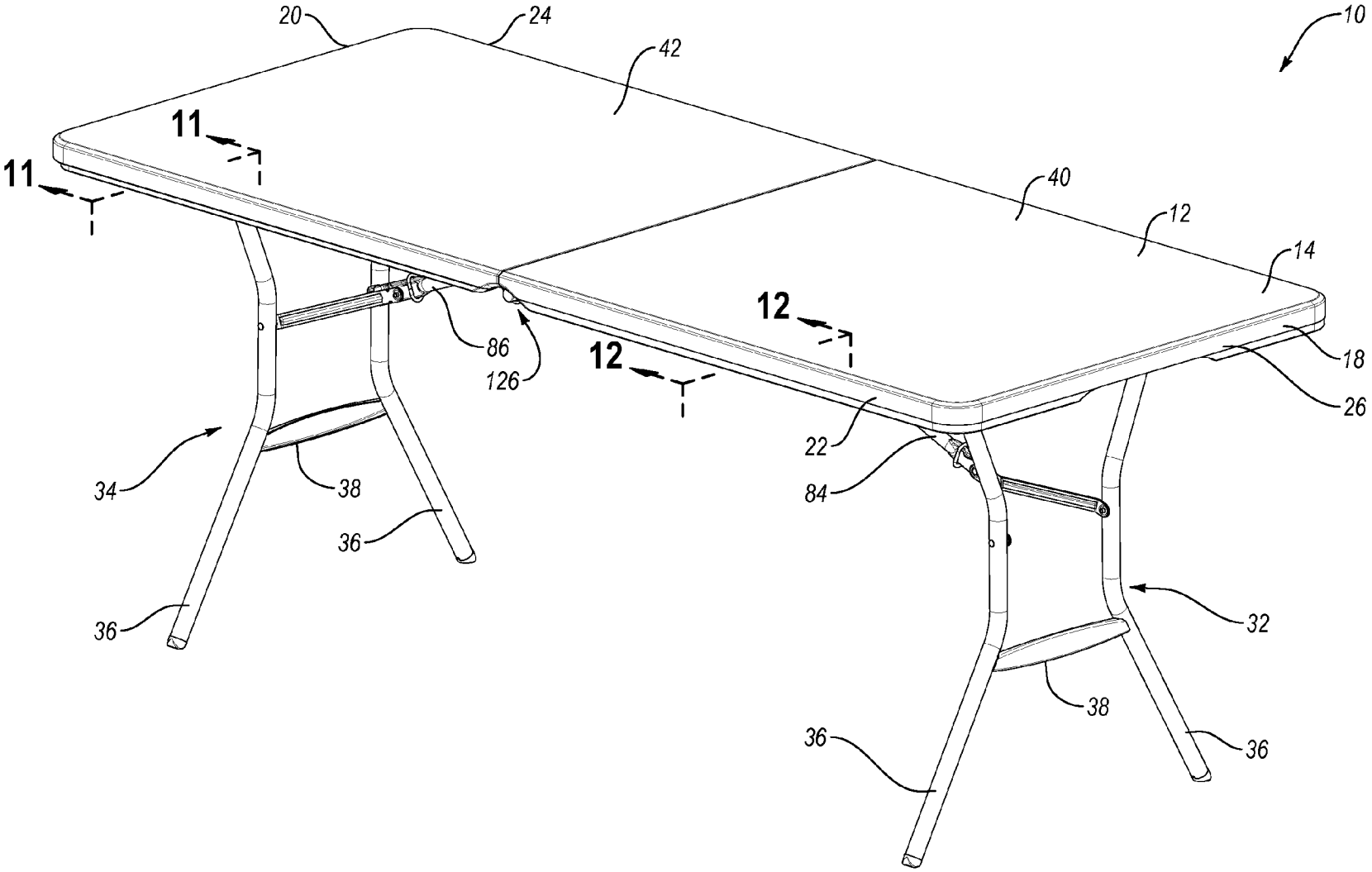
FIG. 1 is an upper perspective view of an exemplary table.
Figure 2:
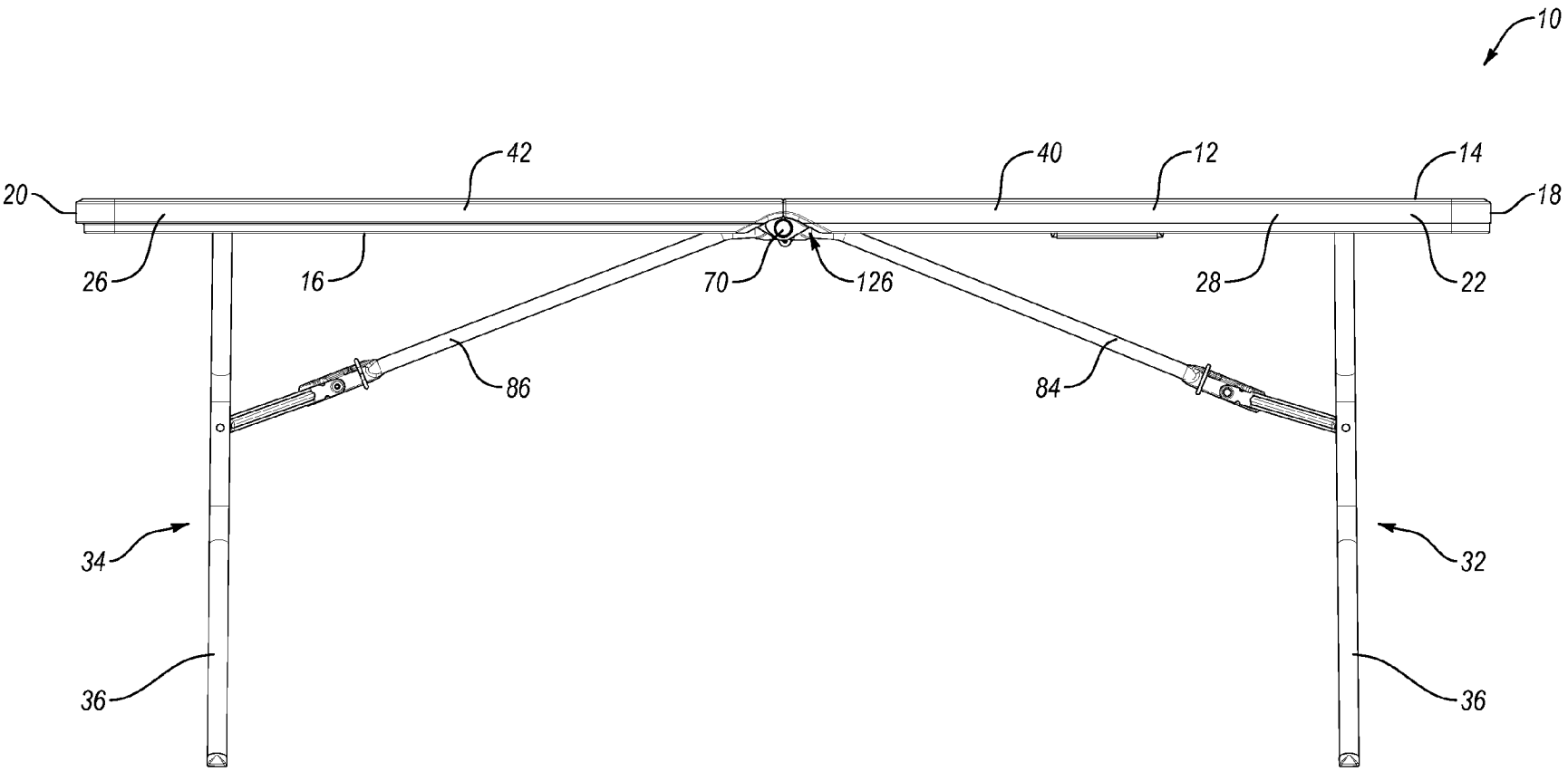
FIG. 2 is a front view of the table shown in FIG. 1.
Figure 3:
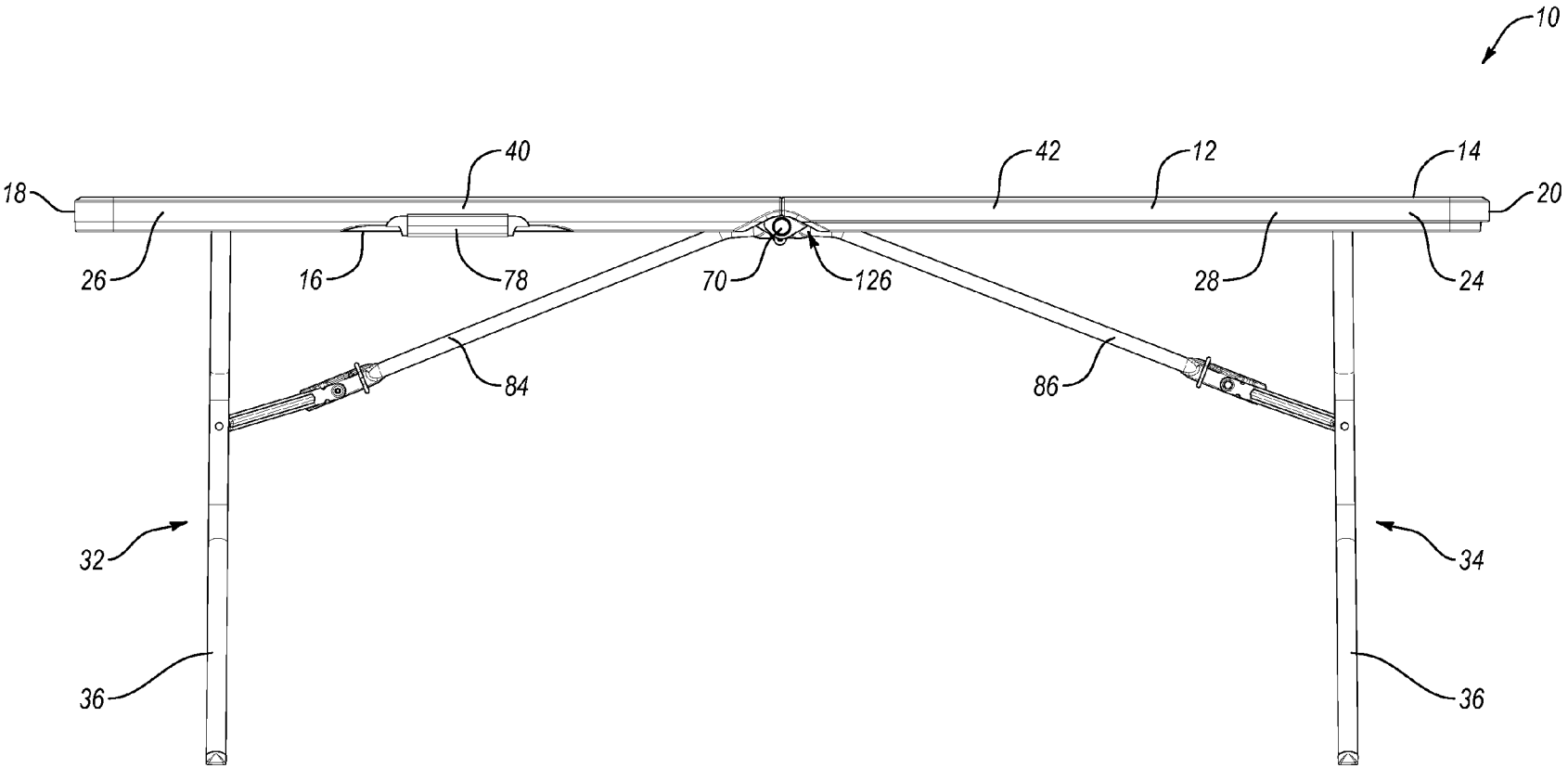
FIG. 3 is rear view of the table shown in FIG. 1.
Figure 5:
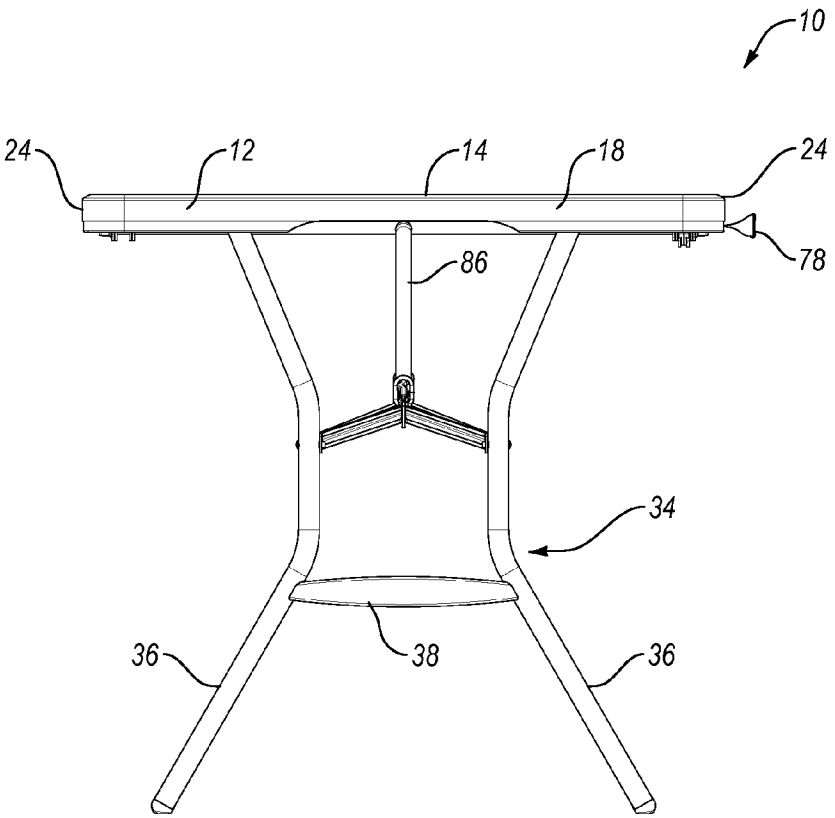
FIG. 5 is a right side view of the table shown in FIG. 1.
Figure 4:
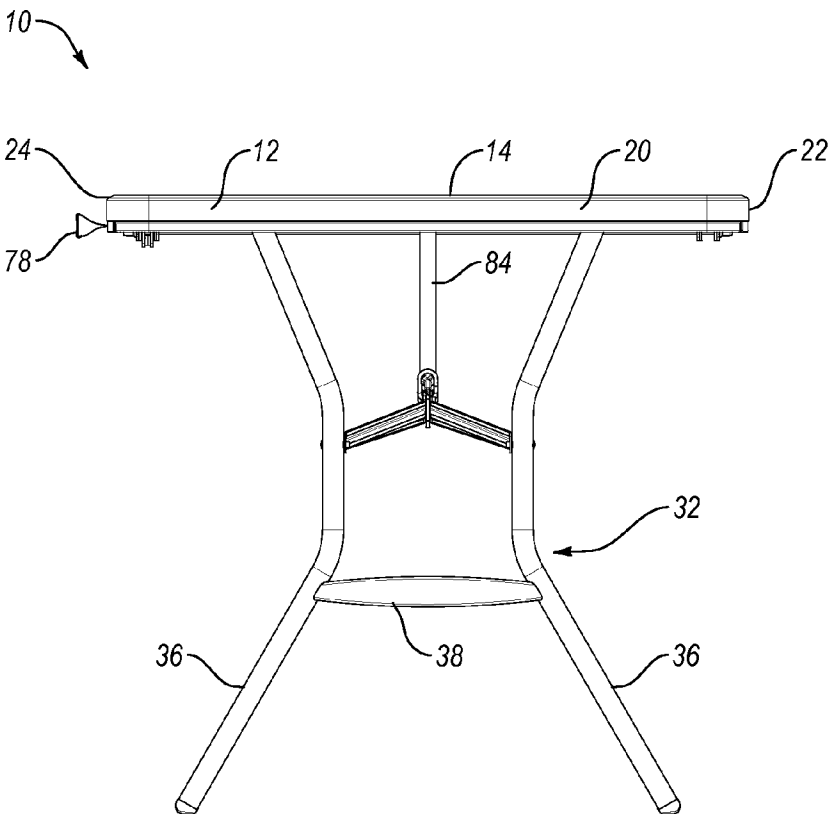
FIG. 4 is left side view of the table shown in FIG. 1.
Figure 6:
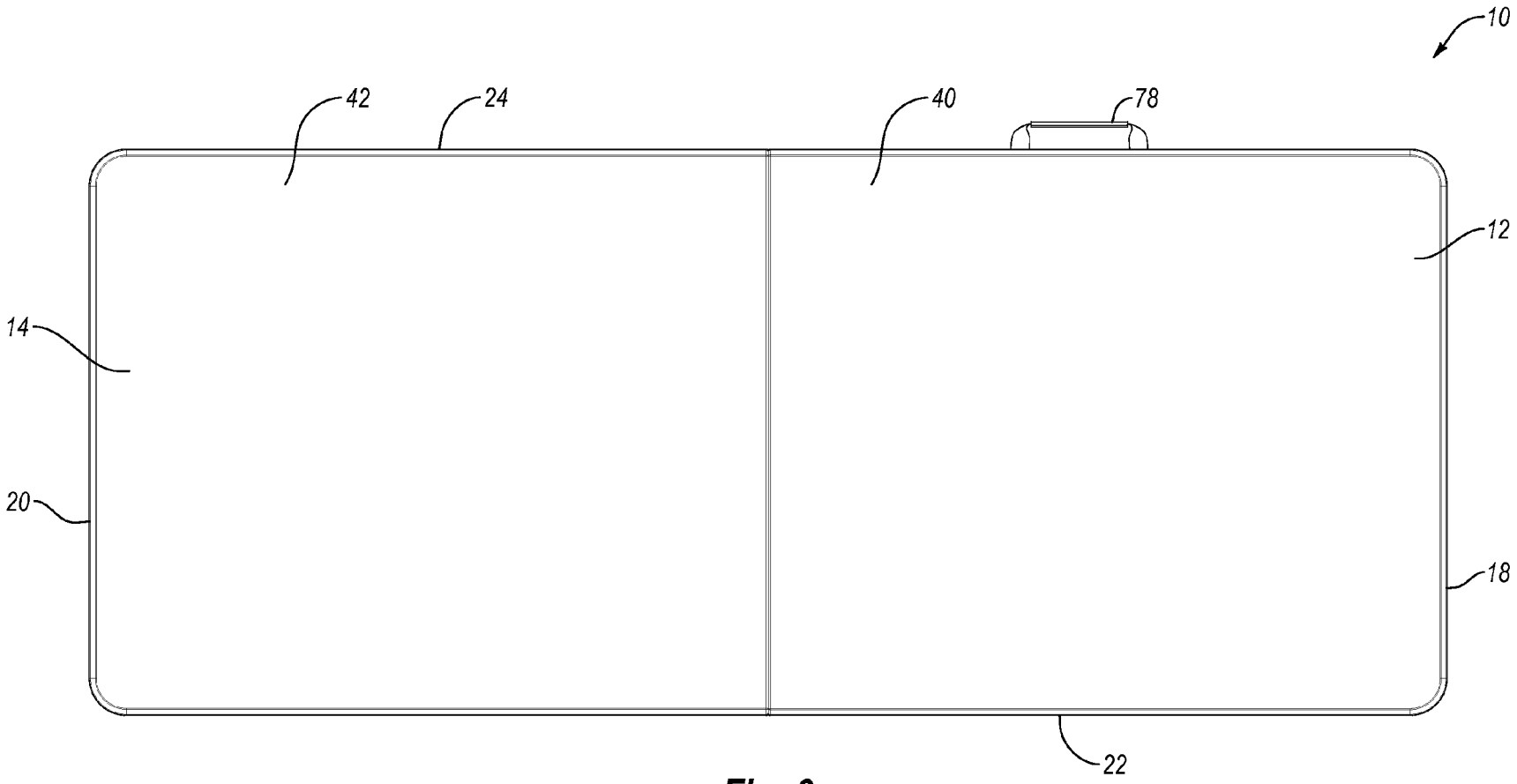
FIG. 6 is a top view of the table shown in FIG. 1.

As shown in FIG. 1, a table 10 may include a table top 12 with an upper portion or surface 14, a lower portion or surface 16, a first end 18, a second end 20, a first side 22 and a second side 24. The upper surface 14 of the table top 12 is preferably generally planar to create a working surface, but the upper surface could also be textured and have other suitable configurations depending, for example, upon the intended use of the table. The table top 12 may also include an edge 26 that is disposed about an outer perimeter or periphery of the table top. All or a portion of the edge 26 may be beveled, sloped or rounded to, for example, increase the comfort and safety of the user. The table top 12 may also include a lip 28 and the lip may extend downwardly from the lower portion 16 of the table top. The lip 28 may be disposed proximate and/or aligned with an outer portion, perimeter and/or the edge 26 of the table top 12. In particular, the lip 28 may extend downwardly relative to the lower surface 16 of the table top 12 and the lip may be aligned with or form a part of the edge 26 of the table top. It will be appreciated that the lip 28 may also be spaced inwardly from the perimeter and/or the edge 26 of the table top 12 and the lip may not be required. It will also be appreciated that the table 10 and its various components may have other shapes, sizes, configurations and arrangements, such as disclosed in U.S. Pat. Nos. 6,530,331; 7,111,563; 7,475,643; 7,814,844; and 7,975,625; each of which are incorporated by reference in its entirety. It will further be appreciated that the table 10 may include any suitable number and combination of features and aspects depending, for example, upon the intended use of the table.

As shown in the accompanying figures, the table top 12 may have a generally rectangular configuration with rounded corners. The table top 12 may also have a relatively large size and the table 10 may be configured for use as a banquet or utility table. For example, the table top 12 may have a length of about five feet (or about sixty inches) and a width of about two and one-half feet (or about thirty inches), and the table top could be larger or smaller depending, for example, upon the intended use of the table 10. For instance, the table top 12 could be between about six and ten feet in length, and between about two and three feet in width. The table top 12 could also have a length between two and four feet in length, and between one and two feet in width. One skilled in the art will appreciate after reviewing this disclosure of the invention that the table top 12 can be larger or smaller; may have other suitable shapes and configurations such as square, circular, oval and the like; and the sides, corners, edges and other portions of the table top could have other shapes, sizes, configurations and arrangements depending, for example, upon the intended use of the table 10. Further, the table 10 could be any suitable type of table such as a folding table, non-folding table, card table, personal table, round table and the like.

The table top 12 may be constructed from lightweight materials such as plastic. In particular, the table top 12 may be constructed from high density polyethylene but other suitable materials can be used. The table top 12 may be constructed from blow-molded plastic which may allow a relatively strong, lightweight, rigid and sturdy table top to be quickly and easily manufactured. The blow-molded plastic table top 12 may be lightweight because it may include a hollow interior portion formed during the blow-molding process. The blow-molded plastic table top 12 may also be relatively durable, weather resistant, temperature insensitive, corrosion resistant, rust resistant and may not deteriorate over time. One of ordinary skill in the art will appreciate the table top 12 does not have to be constructed from blow-molded plastic and other suitable materials and/or processes could be used. For example, the table top 12 may be constructed from other types of plastics, polymers and synthetic materials; and different processes such as injection molding, rotational molding, rotary molding, etc. In addition, the table top 12 may be constructed from other materials with sufficient strength and desirable characteristics such as wood, metals, alloys, composites, fiberglass, ceramics and the like.

Figure 7:
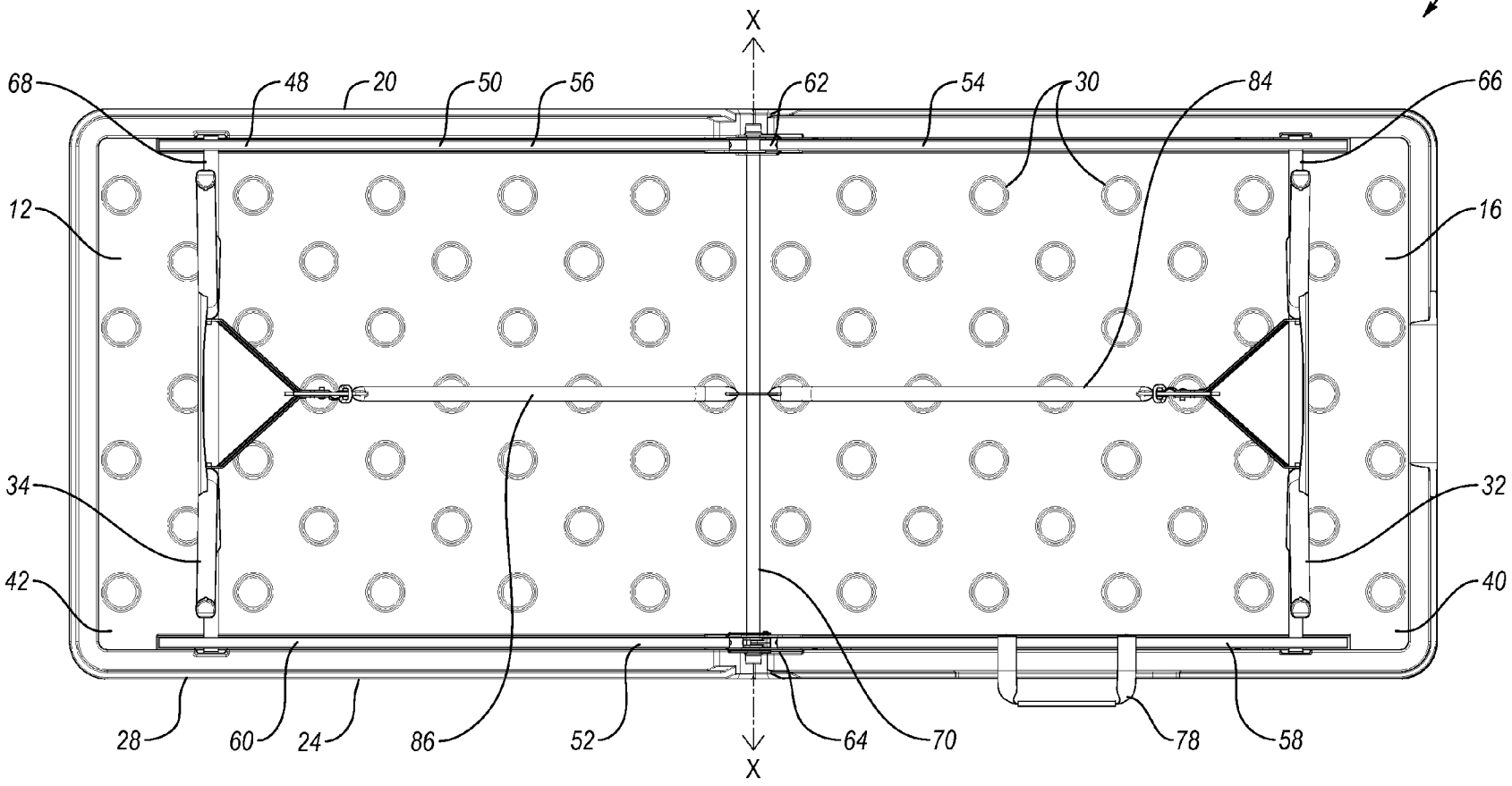
FIG. 7 is a bottom view of the table shown in FIG. 1.

The table top 12 may include spaced apart outer walls, such as the upper surface 14 and the lower surface 16, which may help create a strong and rigid table top. For instance, the upper and lower surfaces 14, 16 of the table top 12 may be separated by a generally constant distance and the surfaces may be generally aligned in parallel planes. As shown in FIG. 7, the table top 12 may include one or more tack-offs, kiss-offs or depressions 30. The depressions 30 may be disposed in the lower surface 16 of the table top 12 and the depressions may be sized and configured to increase the strength and/or rigidity of the table top. The depressions 30 may also be used to create a table top 12 with more uniform properties and characteristics, and the depressions may cover a majority, substantially all or the entire lower surface of the table top. Advantageously, the depressions 30 can be integrally formed with the table top 12 as part of a unitary, one-piece construction or structure. The depressions 30 may be formed in any desired portions of the table top 12 such as the lower surface 16 and the lip 28. The depressions 30, and other portions of the table 10 such as the table top 12 and lip 28, may have other shapes, sizes, configurations, arrangements and features, such as disclosed in U.S. Pat. Nos. 7,069,865; 7,114,453; 7,143,702; and 7,210,277; and U.S. patent publication no. 2006-0230989; which are each incorporated by reference in its entirety.

The table 10 may include one or more support structures, such as legs, that are sized and configured to support the table top 12 above a surface. For example, the table 10 may include a first support structure 32 and a second support structure 34. The first and second support structures 32, 34 may include one or more supports 36 and the supports may be connected by a connecting member 38. The first and second support structures 32, 34 may be movable between an extended or use position in which the support structures extend outwardly and away from the table top 12 and a collapsed or storage position in which the support structures are disposed at least proximate the table top. In the collapsed position, at least a portion of the support structures 32, 34 may contact or abut a portion of the lower surface 16 of the table top 12. The table 10 may include any suitable number, shape, size, configuration and arrangement of support structures, legs, connecting members, feet and the like depending, for example, upon the intended use of the table.

The table 10 may be a folding table and the table top 12 may include a first section 40 and a second section 42. As shown in the accompanying figures, the first support structure 32 may be movable between extended and collapsed positions relative to the first section 40 of the table top 12. The second support structure 34 may be movable between extended and collapsed positions relative to the second section 42 of the table top 12. In addition, the first and second sections 40, 42 of the table top 12 may be foldable about an axis between an unfolded position and a folded position. The first and second sections 40, 42 of the table top 12 may be generally aligned in the same plane when the table top is in the unfolded position, and the first and second sections of the table top may be disposed generally adjacent and parallel to each other when the table top is in the folded position.

As shown in the accompanying figures, the first and section sections 40, 42 of the table top 12 may have a generally rectangular configuration with a generally symmetrical or mirror-image configuration. In addition, the first section 40 of the table top 12 may include an inner surface 44 that is sized and configured to contact, engage and/or be disposed at least proximate an inner surface 46 of the second section 42 of the table top when the table top is in the unfolded position. The inner surfaces 44, 46 of the first and second sections 40, 42 may be spaced apart when the table top 12 is in the folded position. The inner surfaces 44, 46 of the first and second sections 40, 42 of the table top 12 may also be generally aligned and/or disposed in generally the same plane when the table top is in the folded position. The inner surfaces 44, 46 of the table top 12 may include one or more interlocking, overlapping and/or intertwined portions, such as engaging portions and receiving portions, which may provide additional strength, stability and/or rigidity to at least a center portion of the table top. The table top 12 may also have other shapes, sizes, configurations and arrangements, such as shown in U.S. Pat. No. 7,096,799, which is incorporated by reference in its entirety.

The table 10 may further include a frame 48 and the frame may be connected to the table top 12. For example, the frame 48 may be connected to the lower surface 16 and/or the lip 28 of the table top 12. The frame 48 may be connected to the table top 12 by fasteners, adhesives and the like. The frame 48 may also be connected to the table top 12 by brackets, mounting members, etc. The frame 48 may include one or more elongated members, such as rails, and the rails may extend along a length of the table top. In particular, the frame 48 may include a first side rail 50 and a second side rail 52. The first and second side rails 50, 52 may extend along a length of the table top 12 and the side rails may be positioned at least proximate opposing edges and/or sides of the table top. The first and second side 50, 52 rails may also be disposed at least proximate the lip 28. As discussed in greater detail below, the first and second side rails 50, 52 may be spaced apart from the lip 28 by a gap or space. The first and second side rails 50, 52 may also contact and/or abut at least a portion of the lip 28. The first and second side rails 50, 52 preferably extend substantially or almost the entire length of the table top 12, which may provide increased strength and rigidity for the table top, but the side rails may extend along only a portion of the table top.

In greater detail, the first side rail 50 may be disposed towards the first side 22 of the table top 12 and this first side rail may include a first portion 54 connected to the first section 40 of the table top and a second portion 56 connected to the second section 42 of the table top. The second side rail 52 may be disposed towards the second side 24 of the table top 12 and this second side rail may include a first portion 58 connected to the first section 40 of the table top and a second portion 60 connected to the second section 42 of the table top. One of ordinary skill in the art will appreciate, after reviewing this disclosure, the table 12 may include any suitable number, shape, size, configuration and/or arrangements of side rails. One of ordinary skill in the art will also appreciate, after reviewing this disclosure, that the frame 48 and/or side rails 50, 52 could have other suitable shapes, sizes, configurations and arrangements depending, for example, upon the intended use of the table 10. It will further be appreciated, after reviewing this disclosure, that the frame 48 and/or side rails 50, 52 may not be required.

The first and second side rails 50, 52 of the frame 48 may be pivotally connected by a first hinge assembly 62 and a second hinge assembly 64, which may allow the table top 12 to be moved between the folded and unfolded positions. In particular, the first hinge assembly 62 may be connected to the first side rail 50 and the second hinge assembly 64 may be connected to the second side rail 52. One of ordinary skill in the art will appreciate that the hinge assemblies 62, 64 may be connected to other appropriate portions of the table 10, such as the table top 12. One of ordinary skill in the art will further appreciate, after reviewing this disclosure, that other suitable structures may be used to connect the first and second sections of the table top.

The first and second support structures 32, 34 may be connected to the frame 48. For example, a first cross member 66 may connect the first support structure 32 and the frame 48, and a second cross member 68 may connect the second support structure 34 and the frame. In greater detail, the ends of the first and second cross members 66, 68 may be disposed in openings in the side rails 50, 52 of the frame 48, and the cross members 66, 68 may be rotatable relative to the frame. If desired, the cross members 66, 68 may be part of the support structures 32, 34. The cross members 66, 68 may also be separate structures from the support structures 32, 34. For instance, the cross members 66, 68 could form part of the frame 48. The support structures 32, 34 and the cross members 66, 68 may also be connected to the frame 48, the table top 12 and/or other suitable portions of the table 10. For example, the support structures 32, 34 may be attached to the frame 48 such as shown in U.S. Pat. No. 7,100,518, which is incorporated by reference in its entirety. One of ordinary skill in the art will appreciate, after reviewing this disclosure, that the support structures 32, 34, the frame 48 and the cross members 66, 68 may have other suitable shapes, sizes, configurations and arrangements, depending, for example, upon the particular arrangement and/or configuration of the table 10.

Figure 8:
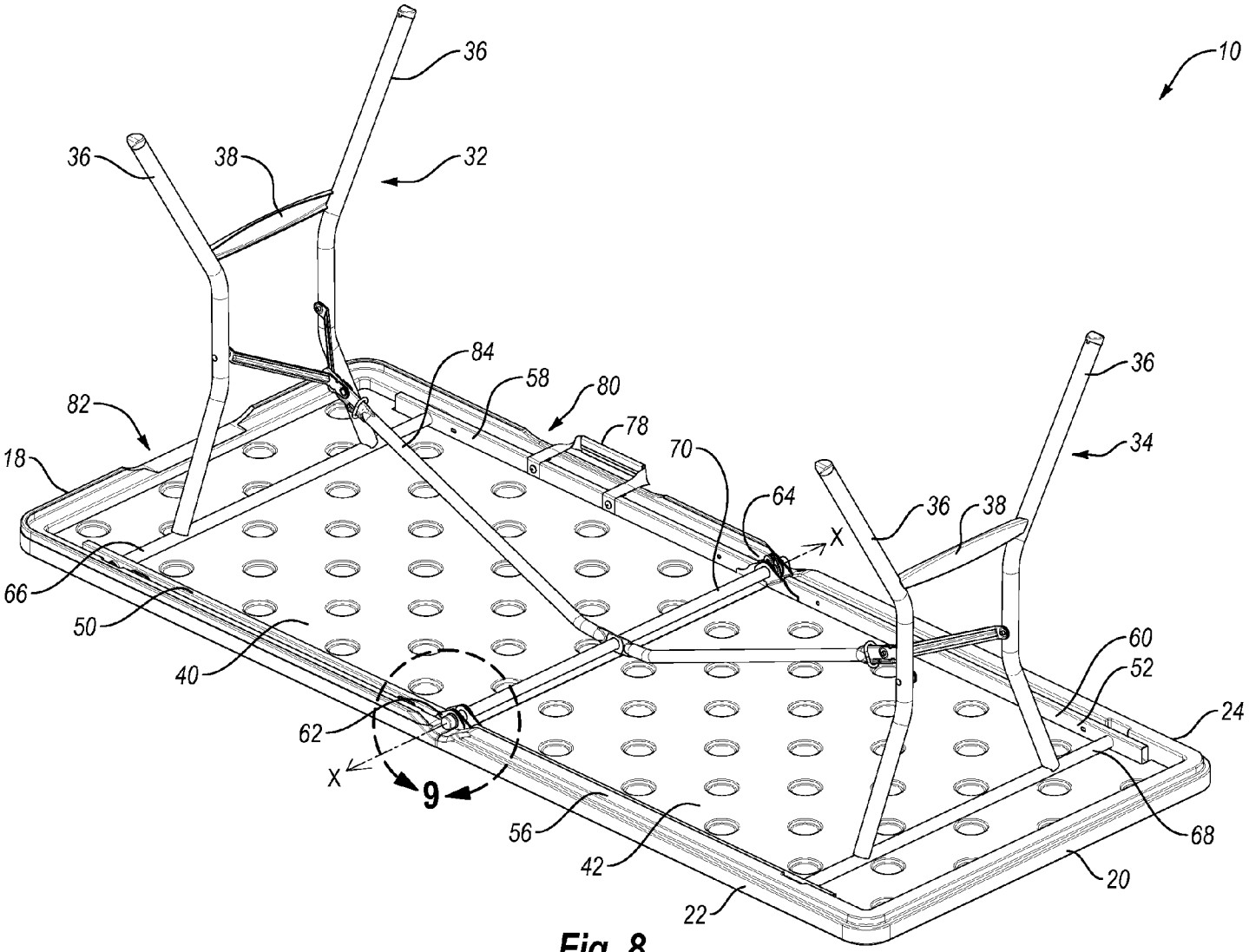
FIG. 8 is a lower perspective view of the table show in FIG. 1.
Figure 9:
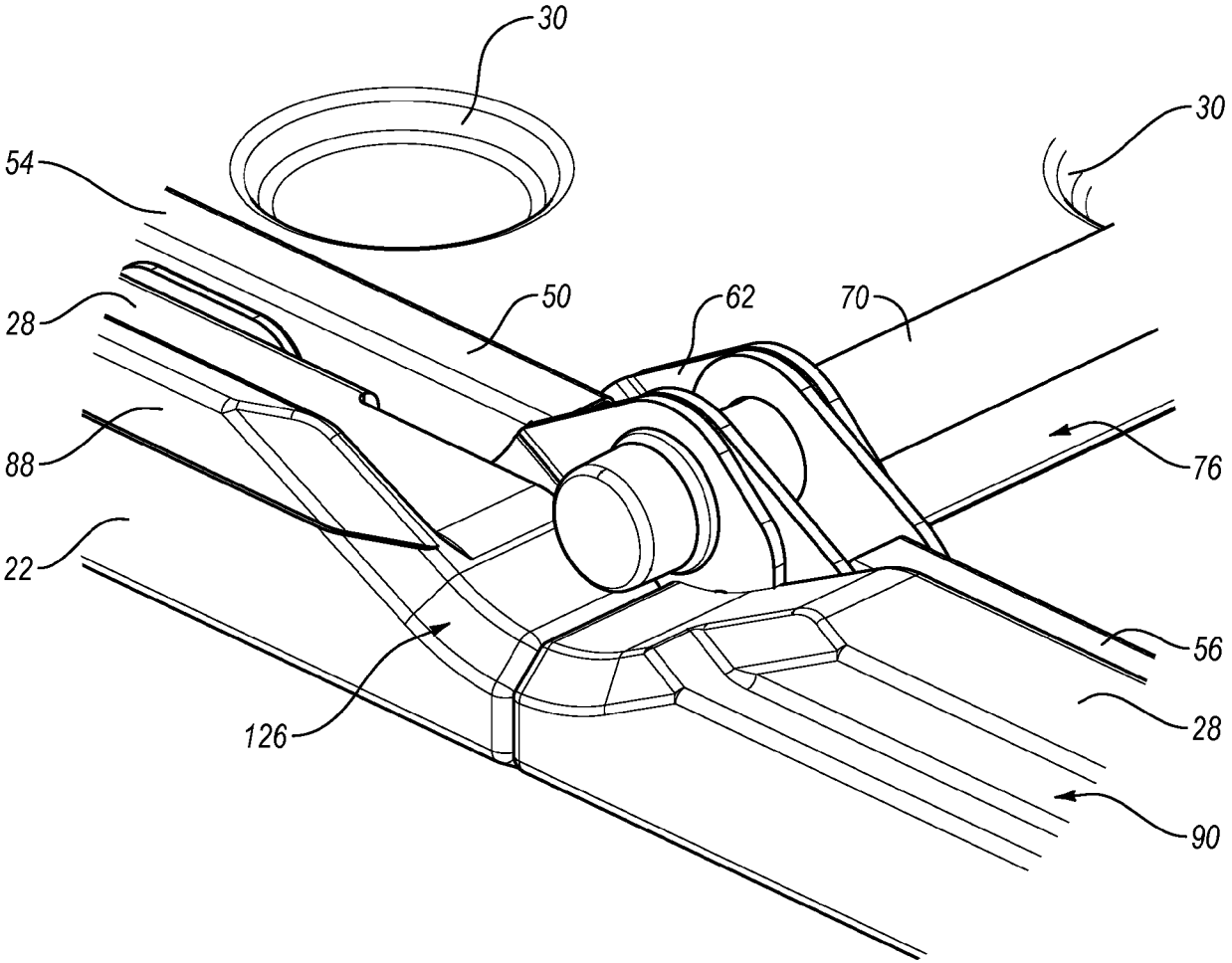
FIG. 9 is an enlarged lower perspective view along lines 9-9 of a portion of the table in FIG. 8.
Figure 10:
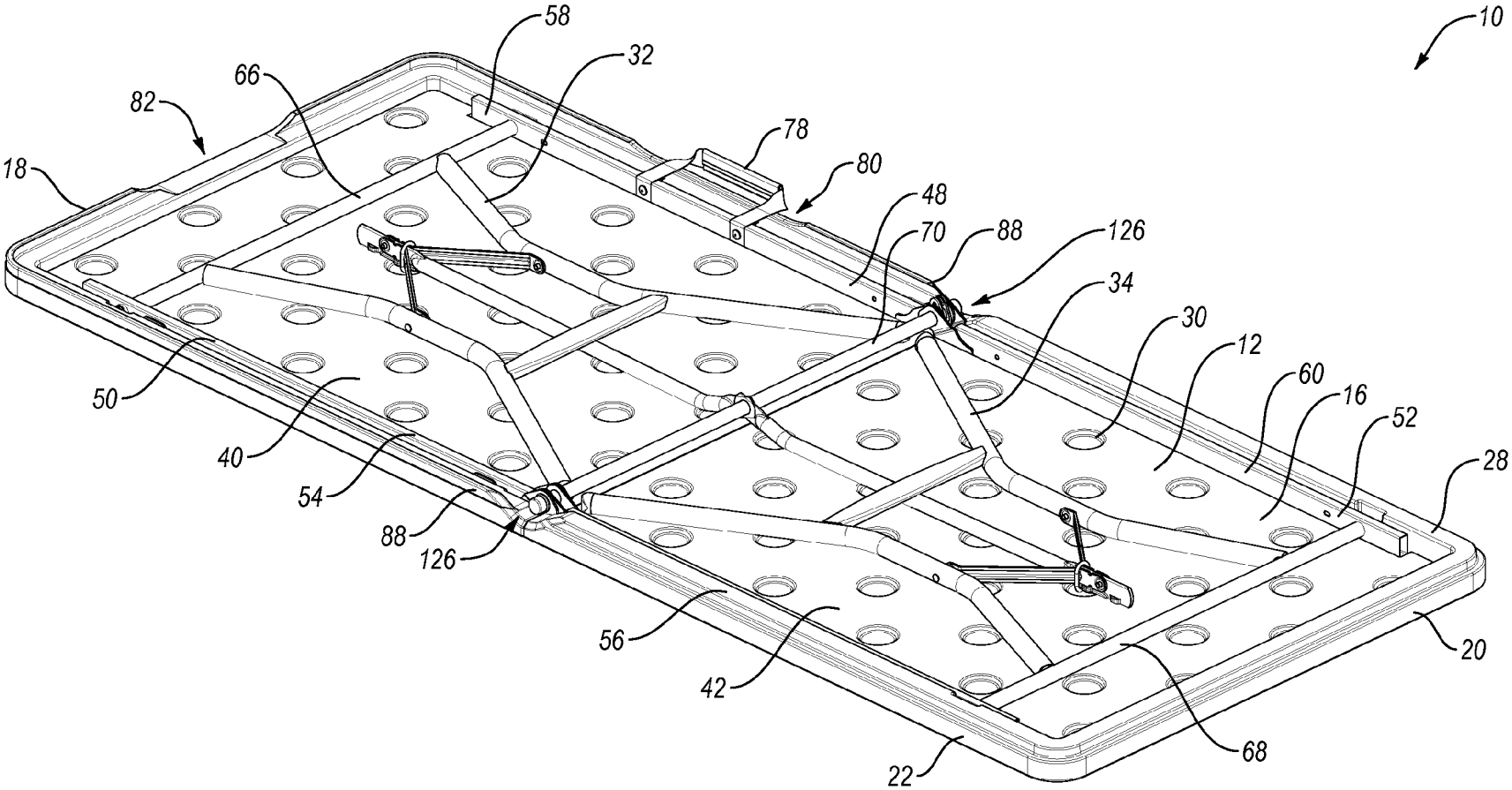
FIG. 10 is a lower perspective view of the table shown in FIG. 1, illustrating the support members in collapsed positions.

A cross member 70 may be disposed at least proximate a center portion of the table top 12. The cross member 70 may be aligned with an axis of rotation X of the table top 12 about which the table top rotates between the folded and unfolded positions. The cross member 70 may also be connected to the first and second hinge assemblies 62, 64. In greater detail, as seen in FIGS. 7 and 8, the ends of the cross member 70 may at least partially or may extend completely through openings in the first and second hinge assemblies 62, 64. This may allow, for example, the axis of rotation X of the table top 12 to be disposed perpendicular to the side rails 50, 52. As discussed in more detail below, this may also allow the axis of rotation X of the table top 12 to be disposed between an upper surface 72 of the side rails 50, 52 and a lower surface 74 of the side rails. At least a portion of the cross member 70 may be disposed in a groove or channel 76 in the lower surface 16 of the table top 12. This may allow the axis of rotation X of the table top 12 to be disposed at least proximate the lower surface 16 of the table top. One of ordinary skill in the art will appreciate, after reviewing this disclosure, that placing the axis of rotation X closer to the lower surface 16 of the table top 12 may allow the table 10 to have a more compact configuration in the folded position.

The cross member 70 may be disposed in a fixed position relative to the table top 12 or it may be movable relative to the table top. For example, the cross member 70 may be rotatable relative to the table top 12. While the axis of rotation X of the table top 10 is preferably aligned with a center of the cross member 70, the axis of rotation does not have to be aligned with the center of the cross member. It will also be appreciated that the cross member 70 may have other suitable shapes, sizes, configurations and arrangements depending, for example, upon the intended use of the table 10. Further, it will be appreciated that the table to may include other features such as those disclosed in U.S. Pat. Nos. 8,397,653; 8,573,139 and 8,555,791; each of which are incorporated by reference in its entirety.

The table 10 may also include other components such as a handle 78 and the handle may be connected to the frame 48. For example, the handle 78 may be connected to the first or second side rail 50, 52 of the frame 48 and the handle may be at least partially disposed in an opening or a handle recess 80 in the lip 28 of the table top 12. The handle 78 could have other suitable shapes, sizes, configurations and arrangements such as those shown in U.S. Pat. Nos. 8,544,393; 8,166,894; 8,156,875; 8,091,490 and 7,735,431; each of which are incorporated by reference in its entirety.

The table 10 may further include other features such as an opening 82, which may be located in the first end 18 of the table top 12. The opening 82 may form at least a portion of a handle and/or may facilitate carrying the table 10. The opening 82 may also be sized and configured to help open the table 10 when the table is disposed in the folded or closed position. Further, the opening 82 may facilitate separating and/or moving the table 10 if the table is stacked with other tables. In addition, the table 10 may include other structures such as a first cross brace 84 connected to the first support structure 32 and the cross member 70, and a second cross brace 86 connected to the second support structure 34 and the cross member 70. The first and second cross braces 84, 86 may help maintain the support structures 32, 34 in the extended or use positions. The cross braces 84, 86 may also be connected to other suitable portions of the table 10 and the cross braces could have other suitable shapes, sizes, arrangements and configurations depending, for example, upon the size and shape of the table 10. It will be understood that the table 10 could include any number of features and components, such as those described above, and other structures. For instance, the table 10 could also include one or more clips and the clips may be used to help maintain the table in the folded position and/or the support structures 32, 34 in the collapsed positions. While the table 10 may include handles, clips and other features, none of these features may be required.

As discussed above, the lip 28 may be sized and configured to provide the table 10 with substantially the same appearance as a conventional table of the same size and configuration, but the lip may allow the table to be disposed in a much more compact configuration in the folded position. The lip 28 may also allow the table 10 to include a frame 48 that provides generally the same or even greater strength and/or rigidity than a conventional frame for a similar table. In particular, the lip 28 may allow substantively the same frame 48 to be used with the table 10 that is used in connection with a similar conventional table, but the lip may allow the table to be disposed in a much more compact configuration in the folded position. Specifically, the lip 28 may allow the frame 48 to have generally the same size and configuration as the frame for a similar conventional table, but the lip may allow the table 10 to have a considerably smaller height or thickness in the folded position. Importantly, the compact configuration may decrease transportation costs because, for example, more tables 10 may be shipped in the same area (such as on a pallet or in a shipping container) and/or the tables may require less space or volume. Advantageously, the compact configuration may also decrease the area required for storing the tables 10. This may reduce costs for the manufacturer and retailer because less storage space may be needed. In addition, purchasers and consumers may store the tables 10 in smaller areas, which may increase the usefulness and situations in which the tables may be used. Further, the compact configuration of the table 10 may be very beneficial to larger facilities such as hotels, schools and convention centers because multiple tables may be more easily stored and moved. Smaller facilities such as restaurants, retailers and homes may also prefer the compact configuration of the table 10 because the tables may be more efficiently stowed and transported.

The lip 28 of the table 10 may have comparable characteristics, such as generally the same height, to the lip of a conventional similar table. Advantageously, because consumers and/or retailers may assume the strength and rigidity of a table is directly proportional to the size of the lip, the lip 28 of the more compact folding table 10 may have substantially the same height as the lip of a conventional table. In particular, the lip 28 of the table 10 may have substantially the same height as the lip of a conventional table when the more compact folding table is in the unfolded position. That is, when the table 10 is being used, the height of the lip 28 may be similar to the height of the lip of a similar conventional table. The lip 28 of the table 10, however, may allow the height of the table to be significantly decreased in the folded position when compared to the height of a similar conventional table in the folded position. Because a significant portion of the lip 28 of the table 10 may overlap, interlock and/or nest when the table is in the folded position, the table may have a significantly smaller height than a conventional table in the folded position. For example, the lip 28 may allow the folded table 10 to have a height between about fifteen percent (15%) and about twenty percent (20%) smaller than a height of a similar conventional folded table. In particular, the folded table 10 may have a height that is about seventeen percent (17%) less than a conventional folded table. This may allow the table 10 to have a height of about 2.5 inches in the folded position while a similar conventional folding table has a height of at least 3.0 inches or more in the folded position. This may advantageously result in sizable savings in shipping, transportation and storage costs of the table 10 in comparison to a similar conventional table.

Figure 11:
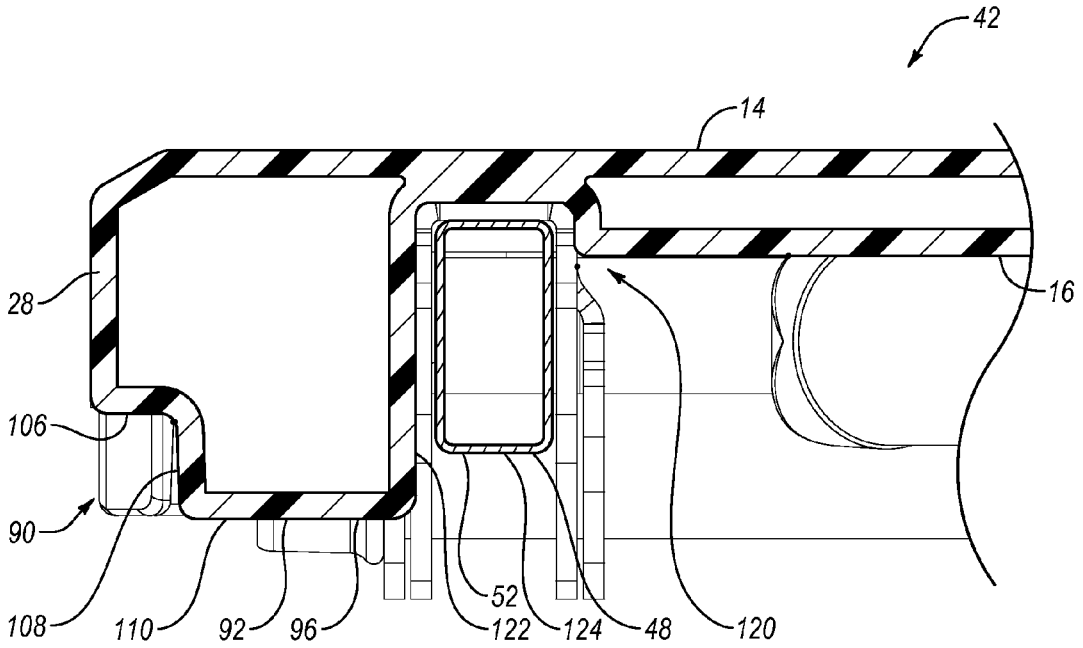
FIG. 11 is an enlarged cross-sectional side view along lines 11-11 shown in FIG. 1 of a portion of the table.
Figure 12:
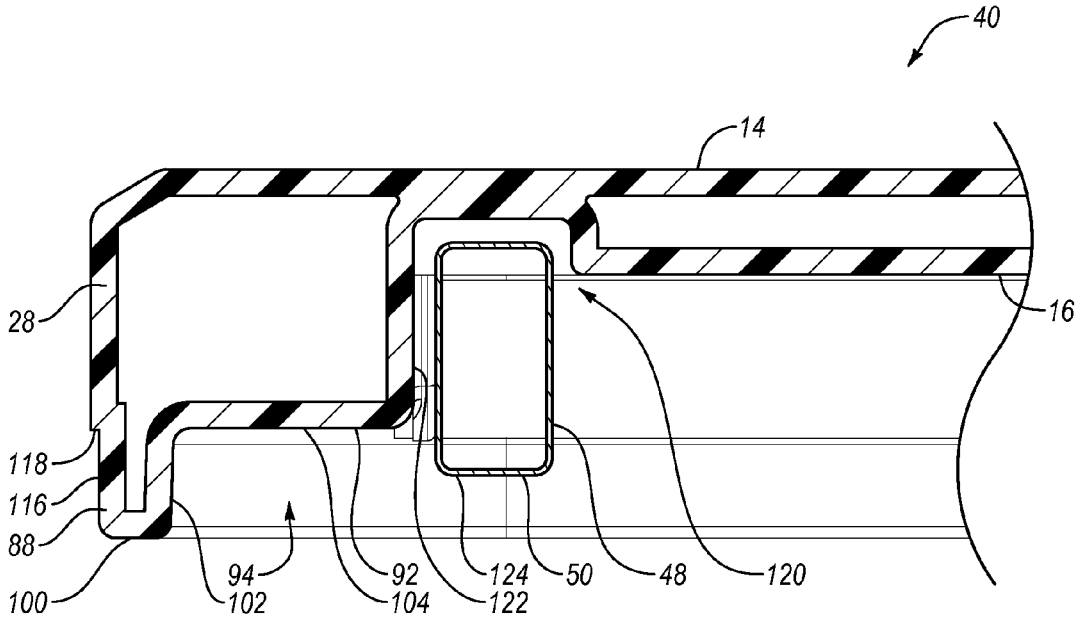
FIG. 12 is an enlarged cross-sectional side view along lines 12-12 shown in FIG. 1 of a portion of the table.
Figure 13:
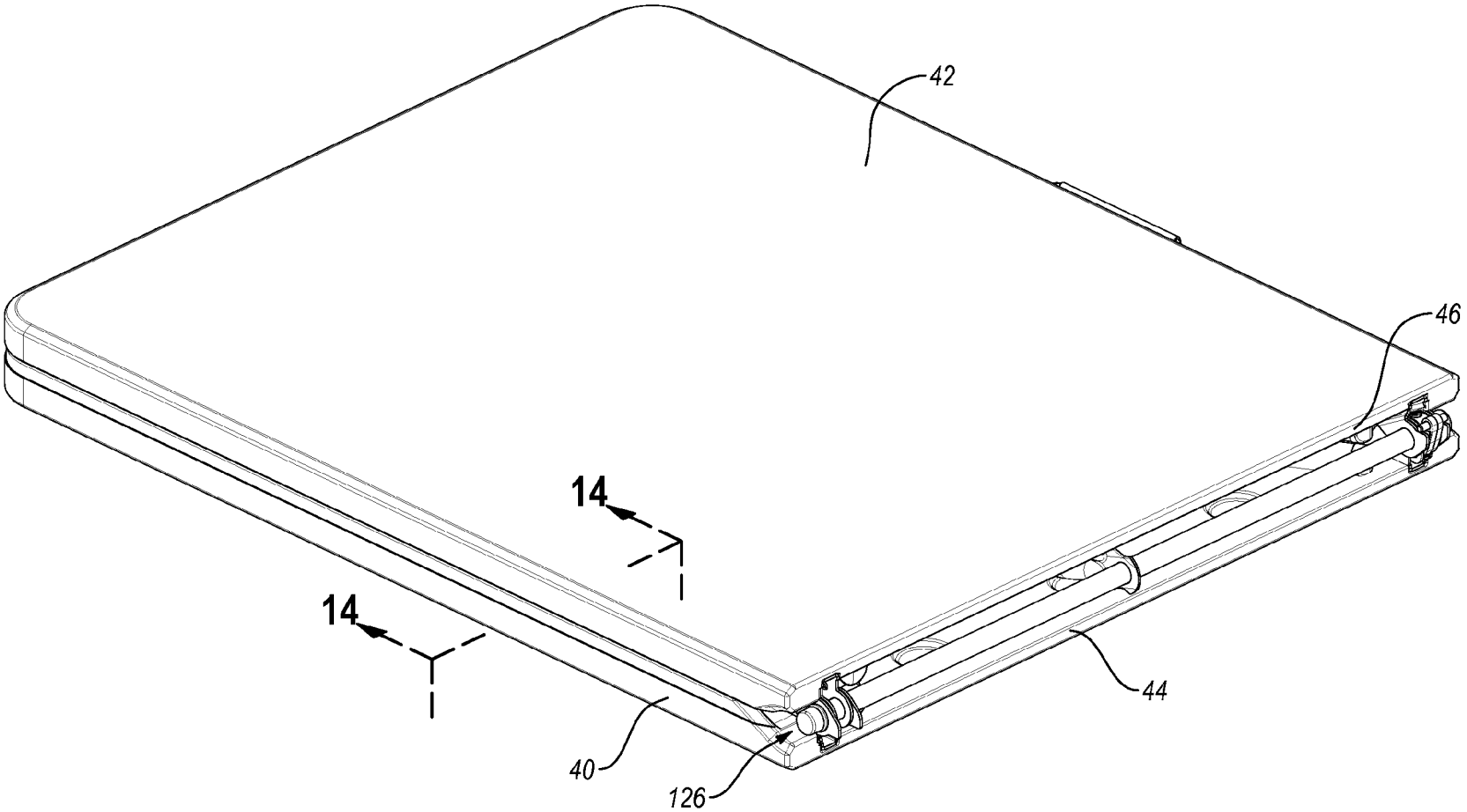
FIG. 13 is an upper perspective view of the table shown in FIG. 1, illustrating the table in a folded configuration.
Figure 14:
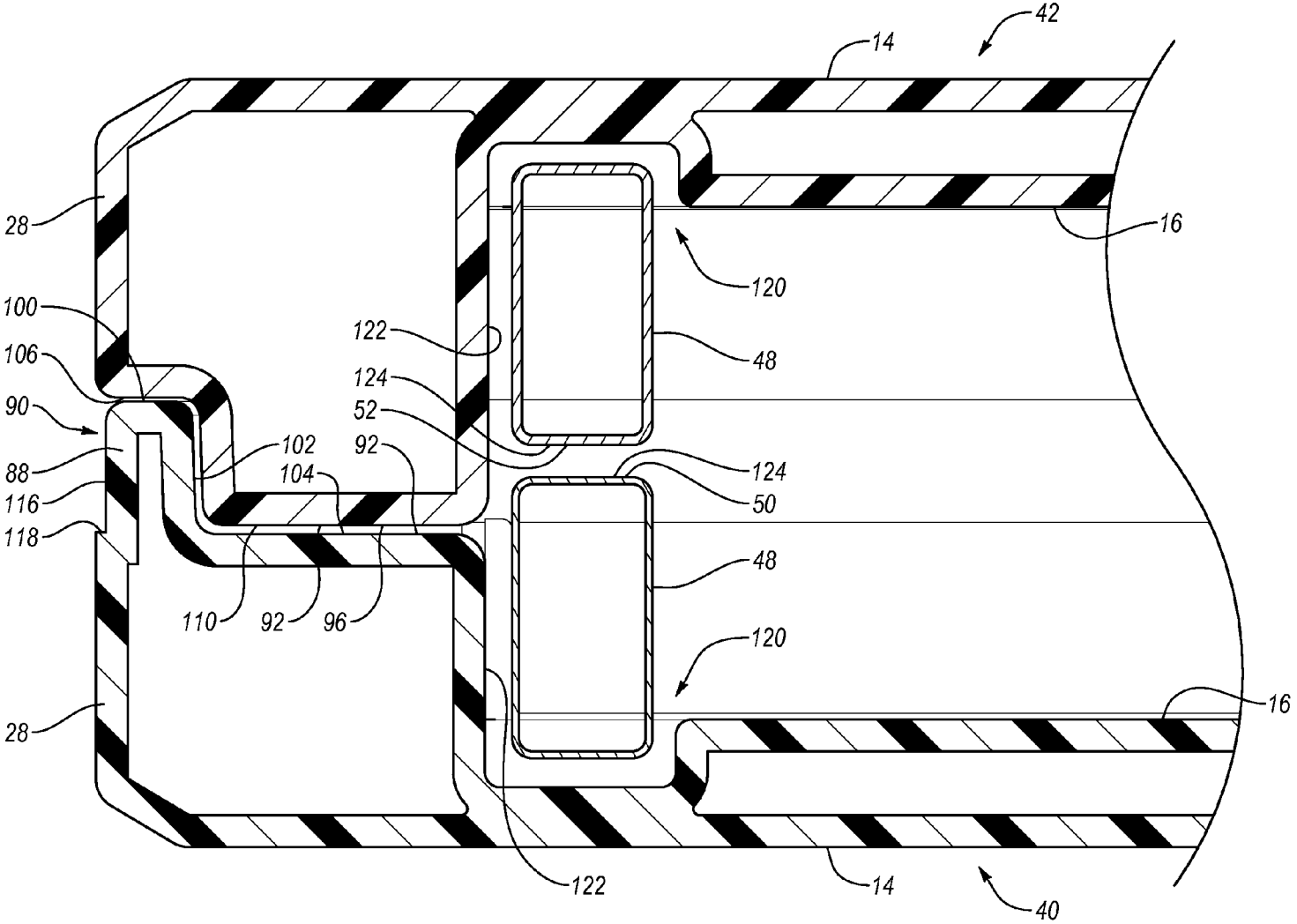
FIG. 14 is an enlarged cross-sectional side view along lines 14-14 shown in FIG. 13 of a portion of the table.

In greater detail, as seen in FIGS. 11, 12 and 14, for example, the lip 28 may include one or more engaging portions 88 and/or one or more receiving portions 90. In particular, the lip 28 on the first section 40 of the table top 12 may include one or more engaging portions 88 and the lip on the second section 42 of the table top may include one or more corresponding receiving portions 90. The receiving portions 90 are preferably sized and configured to receive at least a portion of the engaging portions 88 when the table top 12 is disposed in the folded position. In particular, the engaging portion 88 may be disposed at least proximate an outer perimeter of the lip 28 on the first section 40 of the table top 12. The engaging portion 88 may extend downwardly from the lip 28 and the engaging portion may be disposed at least substantially about the outer perimeter of the first section 40 of the table top 12. The engaging portion 88 may not be along the inner surface 44 of the first section 40 of the table top 12. The receiving portion 90, which may be a cutout, recess, notch or the like, may be disposed at least proximate an outer perimeter of the lip 28 of the second section 42 of the table top 12. The receiving portion 90 may be disposed in the lip 28 and the receiving portion may be disposed at least substantially about the outer perimeter of the second section 42 of the table top 12. The engaging and receiving portions 88, 90 are preferably sized and configured to overlap or nest. In particular, the engaging portion 88 may be at least partially disposed in the receiving portion 90 when the table top 12 is in the folded position. One of ordinary skill in the art will appreciate, after reviewing this disclosure, that the table 10 could include any suitable number, arrangement and combination of engaging and receiving portions 88, 90. For example, the first section 40 of the table top 12 could include one or more engaging and/or receiving portions 88, 90 and the second section 42 of the table top could include one or more engaging and/or receiving portions. One of ordinary skill in the art will also appreciate, after reviewing this disclosure, that the engaging and receiving portions 88, 90 could have a variety of suitable shapes, sizes, configurations and arrangements depending, for example, upon the intended use or shape of the table 10.

As seen in FIGS. 11 and 12, the lip 28 may include a lower surface 92 and the engaging portion 88 may extend outwardly relative to the lower surface while the receiving portion 90 may be disposed in the lower surface. The lower surface 92 of the lip 28 of the first section 40 of the table top 12 may be sized and configured to contact, abut and/or engage the lower surface of the lip of the second section 42 of the table top when the table is in the folded position. Advantageously, the engaging and receiving portions 88, 90 may help position and align the first and second sections 40, 42 of the table top 12 when the table is in the folded position. The engaging and receiving portions 88, 90 may also provide a lip 28 which has generally the same overall height on both the first and second sections 40, 42 of the table top 12. In addition, the engaging and receiving portions 88, 90 may provide a lip 28 with generally the same overall height as the lip of a conventional similar table, but the lip may allow the table 10 to be disposed in a more compact folded configuration.

The lip 28 may also be seen as including a combination of receiving and engaging portions. For example, as seen in FIGS. 11 and 12, the lip 28 on the first section 40 of the table top 12 may include the engaging portion 88 and a receiving portion 94. The lip 28 on the second section 42 of the table top 12 may include the receiving portion 90 and an engaging portion 96. The engaging and receiving portions 88, 90, 94 and 96 may be sized and configured to interact when the table 10 is in the folded position. For instance, the engaging portion 88 of the first section 40 of the table top 12 may be disposed in the receiving portion 90 of the second section 42 of the table top 12. In addition, the engaging portion 96 of the second section 42 of the table top 12 may be disposed in the receiving portion 94 of the first section 40 of the table top when the table is in a folded position. Thus, portions of the lip 28 may overlap and/or nest to decrease the height of the lip when the table 10 is in the folded position. The lip 28, however, may have generally the same appearance and height as the lip of a similar conventional table.

The first section 40 of the table top 12 may be viewed as only including the engaging portion 88 and the second section 42 of the table top may be seen as only including the receiving portion 90. The first section 40 of the table top 12 could also be viewed as having the receiving portion 94 while the second section 42 of the table top could be viewed as having the engaging portion 96. The first section 40 of the table top 12 could also be seen as including the engaging portion 88 and the receiving portion 94 while the second section 42 could be seen as including the receiving portion 90 and the engaging portion 96. Thus, it will be understood the first and second sections 40, 42 of the table top 12 may include one or more engaging portions, one or more receiving portions, or both receiving and engaging portions. Advantageously, the engaging portions 88, 96 and/or the receiving portions 90, 94 may form at least a portion of the lip 28.

The engaging portions 88, 96 and/or the receiving portions 90, 94 may interact to allow the height of the table 10 to be decreased in the folded position. In particular, the lip 28 may have a height that is generally the same as a conventional lip for a similar table, but the engaging and receiving portions may overlap, interlock and/or nest to reduce the height of the lip in the folded position. For example, the lip of a conventional table may have a rectangular configuration with a height of about one and one-half (1.5) inches. Thus, in the folded position, a conventional lip may have a height of about three (3.0) inches. The engaging and receiving portions of the lip 28, however, may significantly reduce the height of the lip in the folded position but may still maintain the same general appearance as the lip for a similar conventional table. For instance, if the engaging portion 88 and the receiving portion 90 have a height of about one-half (0.5) inches, then the lip 28 in the folded position may have a height of about 2.5 inches. This may result in a reduction in the height of the table 10 in the folded position of about seventeen percent (17%).

A portion of the lip 28 may have a generally L-shaped configuration and this may form at least a portion of the engaging portion 88 and/or receiving portion 90. For instance, in this exemplary configuration, the outwardly extending portion may form the engaging portion 88 and a notch or cutout may form the receiving portion 90. The receiving and/or engaging portions 88, 90 may be sized and configured to interact with a corresponding portion of the lip 28 on the other side of the table top 12 when the table 10 is in the folded position. The receiving and/or engaging portions 88, 90 may also have other shapes, sizes, configurations and arrangements depending, for example, upon size of the lip 28 or the intended use of the table 10. Further, the lip 28 may have other shapes, sizes, configurations and arrangements, such as generally U-shaped, generally T-shaped, generally W-shaped and the like. Therefore, it will be understood by a person of ordinary skill in the art, after reviewing this disclosure, that the lip 28, the engaging portions 88, 96 and the receiving portions 90, 94 may have other shapes, sizes, configurations and arrangements.

Advantageously, the lip 28 on the first and second sections 40, 42 of the table top 12 may have generally the same shape, size, configuration and arrangement. In particular, the lip 28 on the first and second sections 40, 42 of the table top 12 may be generally symmetrical, mirror-images and/or disposed in inverted positions. For example, the lip 28 on the first section 40 of the table top 12 may include an engaging portion 88 that is disposed about the outer periphery and the lip on the second section 42 of the table top may include a receiving portion 90 disposed about the outer periphery. When the table 10 is folded the engaging portion 88 on the first section 40 of the table top 12 may be disposed in the receiving portion 90 in the second section 42 of the table top. On the other hand, the lip 28 on the first section 40 of the table top 12 may include an engaging portion 88 that extends from an area near the inner surface 44 to an area at least proximate the opening 82 on one side of this section of the table top. The other side of the first section 40 of the table top 12 could include a receiving portion 90 that extends from an area near the inner surface 44 to an area at last proximate the opening 82 on the other side of the table top. Advantageously, this may allow the first and second sections 40, 42 of the table top 12 to be at least almost symmetrical, if not entirely symmetrical.

In greater detail, as best seen in FIGS. 11, 12 and 14, the lip 28 may include a body 98 and the body may have a generally rectangular or square configuration. The upper surface of the body 98 may be formed by the upper surface 16 of the table top 12 and the lower surface 92 of the lip 28 may form the lower surface of the body. The engaging portion 88 may extend outwardly from the body 98 and the receiving portion 90 may be formed by a channel, notch, grove cutout or opening in the body. As shown in the accompanying figures, the engaging portion 88 may extending downwardly from the lower surface 92 of the lip 28 and/or the engaging portion may be disposed adjacent to the receiving portion 94, which is illustrated in FIG. 12. The receiving portion 90 may be disposed adjacent to the engaging portion 96 and/or the receiving portion may be disposed in the lower surface 92 of the lip 28, which is illustrated in FIG. 11.

The one or more engaging portions are preferably sized and configured to be at least partially disposed in corresponding receiving portions when the table 10 is in the folded position. For example, the engaging portion 88 may be disposed in the receiving portion 90 when the table 10 is in the folded position. The engaging portion 96 may also be disposed in the receiving portion 94 when the table 10 is in the folded position.

One or more portions of the lip 28 may contact or abut when the table 10 is in the folded position. For example, as seen in FIG. 12, the lip 28 on the first section 40 of the table top 12 may include a first surface 100, a second surface 102 and a third surface 104. As seen in FIG. 11, the lip 28 on the second section 42 of the table top 12 may include a first surface 106, a second surface 108 and a third surface 110. As a non-limiting example, the first and second surfaces 100, 102, 106, 108, may be substantially parallel to one another; and the third surfaces 104, 110 may be substantially perpendicular to the first and/or second surfaces. If desired, the first surfaces 100, 106 may be generally aligned and/or disposed in the same plane, and the second surface 102, 108 may be generally aligned and/or disposed in the same plane. The engaging portion 88, 96 and the receiving portion 90, 94 of the lip 28 on the first and second sections 40, 42 of the table top 12 may be juxtaposed or positioned such that the first surfaces 100, 106; the second surfaces 102, 108; and/or the third surfaces 104, 110 may be adjacent, contact and/or abut when the table 10 is in the folded position. In particular, the first surface 100, the second surface 102 and the third surface 104 of the lip 28 on the first section 40 of the table top 12 may be adjacent, contact and/or abut the corresponding first surface 106, the second surface 108 and the third surface 110 of the lip on the second section 42 of the table top when the table 10 is in the folded position. The first, second and third surfaces of the lip 28 on the first section 40 of the table top 12 may be viewed as engaging surfaces and the first, second and third surfaces on the second section 42 of the table top may be viewed as receiving surfaces. Alternatively, the first, second and third surfaces on the first section 40 of the table top 12 may be viewed as receiving surfaces, and the first, second and third surfaces on the second section 42 of the table top may be viewed as engaging surfaces. While the lip 28 on the first section 40 of the table top 12 may have substantially the same configuration as the lip on the second section 42 of the table top, the lip may also have other suitable configurations.

As shown in FIG. 12, the engaging portion 88 may include a hollow interior portion 112 and the lip 28 may include a hollow interior portion 114. If the table top 12 is constructed from blow-molded plastic, the hollow interior portion 112 of the engaging portion 88 and the hollow interior portion 114 of the lip 28 may be in direct fluid communication. Advantageously, the lip 28, the engaging portion 88, the hollow interior portion 112 and the hollow interior portion 114 may be integrally formed as part of a unitary, one-piece structure. The engaging portion 88, however, does not require the hollow interior portion and could be formed as part of a compression member or edge during the blow-molding process. For instance, the engaging portion 88 could include an outer surface 116 that is in direct contact with the second surface 102, which could create a solid structure.

The outer surface of the table top 12 may also include a step or indentation 118, such as a notch. The step 118 may be disposed about a portion of the lip 28 and, as shown in FIG. 12, the step may be generally aligned with the lower surface 92 of the lip and/or the third surface 104 on the first section 40 of the table top 12. The step 118 may also be positioned so that it is generally aligned with the lower surface of the receiving portion 90 or the first surface 106 of the second section 42 of the table top 12. Advantageously, when the table top 12 is in the unfolded or use position, the step 118 and a portion of the receiving portion 90 may be generally aligned, which may help create an aesthetically pleasing table 10.

As shown in FIGS. 11, 12 and 14, the frame 48 may be disposed at least proximate the lip 28. In particular, the first side rail 50 and the second side rail 52 may be at least partially disposed within a frame receiving portion 120 and the frame 48 may be positioned near or may contact an inner surface 122 of the lip 48. The frame 48 is preferably disposed within the frame receiving portion 120 to allow the height of the table 10 to be decreased in the folded position. For example, the frame receiving portion 120 may be disposed in the lower surface 16 of the table top 12 and the receiving portion may extend towards the upper surface 14 of the table top. As shown in the accompanying figures, the lower surface 16 of the table top 12 may contact, abut or engage the upper surface 14 of the table top. If the table top 12 is constructed from blow-molded plastic, the contact of the lower surface 16 with the upper surface 14 of the table top 12 may occur during the blow-molding process. The contact of the lower surface 16 and the upper surface 14 may extend along the length of the first side rail 50 and the second side rail 52.

If the frame 48 is disposed in the receiving portion 120, a lower surface 124 of the side rails 50, 52 may contact or abut when the table 10 is in the folded position. Advantageously, if one or both of the side rails 50, 52 are disposed in the receiving portion 120, the height of the table 10 in the folded position may be decreased.

The height of the table 10 in the folded position may also be decreased by disposing the engaging portions, such as engaging portion 88, in the receiving portions, such as the receiving portion 90. In addition, the receiving and engaging portions 88, 90 may help align the first and second sections 40, 42 of the table top 12 and/or secure the first and second section sections of the table top in a fixed position when the table 10 is in the folded position. In addition, because the receiving and engaging portions 88, 90 may have complementary or corresponding shapes, sizes, configurations and/or arrangements, the receiving and engaging portions may be interchangeable. Thus, for example, the lip 28 could include any suitable combination, number and/or arrangement of receiving and engaging portions.

In particular, the engaging and receiving portions 88, 90 may have generally the same height. In addition, the width of the engaging and receiving portions 88, 90 may be generally the same. In greater detail, the height of the engaging and receiving portions 88, 90 may be between approximately twenty and forty percent (20-40%) of the height of the lip 28. More specifically, the height of the engaging and receiving portions 88, 90 may be about twenty-five percent (25%) or about thirty percent (30%) of the height of the lip 28. The engaging and receiving portions 88, 90 may have a width approximately equal to or less than one-half of the width of the lip 28. Specifically, the engaging and receiving portions 88, 90 may have a width between about twenty percent (20%) and thirty (30%), such as about twenty-five percent (25%), of the width of the lip 28. Additionally, the receiving portion 90 may have a depth and the engaging portion 88 may have a height that is approximately equal to one-third of a height of the body 98 of the lip 28. It will be understood the engaging and receiving portions 88, 90 may have other suitable dimensions such as a width between about one-third and about one-fourth of the width of the body 98 of the lip 28; and/or a height or depth between about one-half and about one-quarter of the height of the body of the lip. In particular, an exemplary embodiment of the lip 28 may include a body 98 with a height of about 1.25 inches and a width of about 1.5 inches. The engaging portion 88 may have a height of about one-half (0.5) of an inch so the overall height of the lip 28 may be about 1.75 inches. Thus, a comparable conventional table would have a height of about 3.5 inches in the folded position, but this exemplary lip 28 may only have a height of about 2.5 inches in the folded position. Therefore, this exemplary lip 28 would have a height that is approximately thirty percent (30%) less than a lip of a corresponding conventional table. It will also be understood the lip 28, the engaging portion 88 and the receiving portion 90 may have other suitable shapes, sizes, configurations and arrangements depending, for example, upon the intended use of the table.

For instance, the lip 28 could have a generally U-shaped configuration with a body, a first engaging portion, a second engaging portion and a receiving portion. The lip 28 on the other side of the table top could have a corresponding configuration with one or more receiving portions to receive the first and second engaging portions of the lip when the table is in the folded position and/or one or more engaging portions disposed in the receiving portion when the table is in the folded position. In another example embodiment, the lip 28 could have a generally T-shaped configuration with a body, a first receiving portion, a second receiving portion and an engaging portion. A corresponding lip 28 on the other side of the table top could include one or more engaging portions sized disposed in the receiving portions when the table is in the folded position and/or a receiving portion to receive the engaging portion of the lip when the frame is in the folded position. Further, another exemplary lip 28 could have a generally W-shaped configuration with a body, a first engaging portion, a second engaging portion and a third engaging portion. The lip 28 could also include a first receiving portion and a second receiving portion disposed between the engaging portions. A corresponding lip 28 could include a plurality of receiving portions to receive the engaging portions when the table 10 is in the folded position and/or a plurality of engaging portions disposed in the receiving portions when the table is in the folded position. Thus, it will be understood by a person of ordinary skill in the art after reviewing the disclosure herein that the lip 28, the frame 48, the engaging portion 88 and/or the receiving portion 90 may have a variety of shapes, sizes, configurations and arrangements depending, for example, upon the intended use of the table 10.

Advantageously, the axis of rotation X may be positioned closer to the lower surface 16 of the table top 12. For example, the engaging and receiving portions 88, 90 of the lip 28 and/or the frame receiving portion 120 may allow the axis of rotation X to be positioned closer to the lower surface 16 of the table top 12. In greater detail, the axis of rotation X may be disposed between an uppermost portion of the engaging portion 88 of the lip 28 on one side of the table top 12 and a lowermost portion of the receiving portion 90 of the lip on the other side of the table top. The axis of rotation X may be disposed between the body 98 of the lip 28 on the first section 40 of the table top 12 and the body of the lip on the second section 42 of the table top when the frame is folded. The axis of rotation X may also be disposed proximate a midpoint of the engaging and/or receiving portions 88, 90 for the first and/or second sections of the table top 12. Because the axis of rotation X may be disposed below the lower portion of the lip 28, this may allow the height of the table 10 to be decreased in the folded position.

The axis of rotation X may be aligned with the cross member 70 and the cross member may be sized and configured such that it is disposed between the lowermost portion of the lip 28 on the first section 40 of the table top 12 and the lowermost portion of the lip on the second section 42 of the table top when the table is folded. The cross member 70 may also be disposed between the body 98 of the lip 28 on the first section 40 of the table top 12 and the body of the lip on the second section 42 of the table top when the table is folded. The cross member 70 may further be disposed proximate a midpoint of the receiving portion 88 and/or the engaging portion 90 of the first and second sections 40, 42 of the table top 12. In addition, the cross member 70 may be disposed proximate a midpoint of the lip 28 or a portion of the lip such as the engaging portion 88 or the receiving portion 90. In addition, the cross member 70 may have a diameter that is less than the depth of the receiving portion 90 and/or the height of the engaging portion 90, if desired.

The axis of rotation X may extend through an opening 126 in the lip 28. For example, as seen in FIG. 8, the axis of rotation may be disposed between a lowermost portion of the lip 28 and the lower surface 16 of the table top 10. The opening 126 may be curved or rounded and may be sized and configured to allow the table 10 to be moved between the folded and unfolded positions. One of ordinary skill in the art, after reviewing this disclosure, will understand that the opening 126 may have other suitable shapes, sizes, configurations and arraignments depending, for example, upon the intended use of the table 10.

The frame 48; the hinge assemblies 62, 64; the cross members 66, 68, 70; the support structures 32, 34; and other portions of the table 10 may be constructed from relatively high-strength materials such metal, which may easily be formed into the desired configuration by known operations such as stamping and bending. These and other components of the table 10 may also be constructed from other materials such as plastics, composites, and the like. It will be appreciated that the frame 48; the hinge assemblies 62, 64; the cross members 66, 68, 70; the support structures 32, 34; and the like may have various suitable shapes, sizes, configurations and arrangements depending, for example, upon the size and shape of the table top and/or the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A folding table comprising:

a table top including a first section and a second section, the first and second sections movable between a folded position in which the first and second sections are disposed in a generally adjacent and parallel configuration and an unfolded position in which the first and second sections are generally aligned in the same plane;

a first lip extending downwardly from the first table top section, the first lip comprising a body, an engaging portion and a receiving portion;

a second lip extending downwardly from the second table top section, the second lip comprising a body, an engaging portion and a receiving portion;

a first support structure connected to the first section of the table top, the first support structure movable between an extended position in which the first support structure extends outwardly from the first section of the table top and a collapsed position in which the first support structure is disposed generally parallel and at least proximate the first section of the table top;

a second support structure connected to the second section of the table top, the second support structure movable between an extended position in which the second support structure extends outwardly from the second section of the table top and a collapsed position in which the second support structure is disposed generally parallel and at least proximate the second section of the table top;

a frame comprising a first portion connected to the first section of the table top and a second portion connected to the second section of the table top; and a hinge assembly connecting the first portion of the frame and the second portion of the frame, the hinge assembly sized and configured to allow the first section of the table top and the second section of the table top to move between the folded and the unfolded positions;

wherein, when the table top is disposed in the folded position, the engaging portion of the first lip of the first table top section is at least partially disposed in the receiving portion of the second lip of the second table top section; and wherein, when the table top is disposed in the folded position, the engaging portion of the second lip of the second table top section is at least partially disposed in the receiving portion of the first lip of the first table top section.

2. The folding table as in claim 1, wherein the engaging portion of the first lip and the receiving portion of the second lip at least substantially overlap when the table is in the folded position.

3. The folding table as in claim 1, wherein the first lip has a first height and the second lip has a second height; and wherein a total height of the first lip and the second when the table is in the folded position is at least about fifteen percent smaller than the height of the first lip and the height of the second lip.

4. The folding table as in claim 3, wherein the first lip and the second lip have generally the same size, shape and configuration;

wherein the first lip and the second lip are generally aligned and coplanar; and wherein the first lip and the second lip have an inverted position relative to a lower surface of the table top to allow the engaging portion to be disposed in the receiving portion when the table is in the folded position.

5. The folding table as in claim 1, wherein the lip has a height that is at least ten percent less than a height of the first lip and the second lip when the table is in the folded position.

6. The folding table as in claim 1, wherein the lip has a height that is at least twenty percent less than a height of the first lip and the second lip when the table is in the folded position.

7. The folding table as in claim 1, wherein the first lip has a generally L-shaped configuration and the second lip has a generally L-shaped configuration; and wherein the first lip and the second lip nest together when the table is in the folded position.

8. The folding table as in claim 1, further comprising a frame receiving portion in a lower surface of the first table top section and the second table top section, the lower surface contacting an upper surface of the table top to form at least a portion of the frame receiving portion.

9. The folding table as in claim 1, wherein the table top rotates about an axis of rotation between the folded position and the unfolded position; and wherein the axis of rotation is disposed between a plane aligned with a lower surface of the table top and a plane aligned with a lower surface of the first lip and a lower surface of the second lip.

10. The folding table as in claim 1, wherein the engaging portion of the first lip includes a hollow interior portion that is in direct fluid communication with a hollow interior portion of the lip, the hollow interior portion of the engaging portion and the lip being integrally formed as part of a unitary one-piece structure during a blow-molding process.

11. A table top for a folding table that is capable of moving between a folded position and an unfolded position, the table top comprising:

a first table top section;

a lip extending downwardly from the first table top section, the lip comprising a body, an engaging portion and a receiving portion;

a second table top section, the first table top section and the second table top section generally aligned in the same plane when the table top is in the unfolded position, the first table top section and the second table top section disposed generally adjacent and parallel to each other when the table top is in the folded position;

a lip extending downwardly from the second table top section, the lip comprising a body, an engaging portion and a receiving portion; and a connecting member connecting the first table top section and the second table top section, the connecting member sized and configured to allow the table top to move between the folded position and the unfolded position;

wherein the engaging portion of the lip of the first table top section is at least partially disposed in the receiving portion of the lip of the second table top section when the table top is in the folded position; and wherein the engaging portion of the lip of the second table top section is at least partially disposed in the receiving portion of the lip of the first table top section when the table top is in the folded position.

12. The table top as in claim 11, wherein the engaging portion and the receiving portion of the lip of the first table top section have a generally L-shaped configuration; and wherein the engaging portion and the receiving portion of the lip of the second table top section have a generally L-shaped configuration.

13. The table top as in claim 11, wherein the engaging portion extends outwardly from the body of the lip of the first table top section; and wherein the engaging portion extends outwardly from the body of the lip of the second table top section.

14. The table top as in claim 11, wherein the receiving portion comprises a notch in the body of the lip of the first table top section; and wherein the receiving portion comprises a notch in the body of the lip of the second table top section.

15. A folding table top, the folding table top movable between a folded position in which a first portion of the table top is disposed generally adjacent and parallel to a second portion of the table top and an unfolded position in which the first portion and the second portion of the table top are generally aligned in the same plane, the folding table top comprising:

a first section of the table top;

a first lip extending downwardly from the first table top section, the first lip comprising a body and an outwardly extending engaging portion;

a second section of the table top;

a second lip extending downwardly from the second table top section, the second lip comprising a body and a receiving portion sized and configured to at least partially receive the engaging portion of the first lip of the first table top section when the folding table top is in the folded position; and a connecting member connecting the first table top section and the second table top section, the connecting member sized and configured to allow the table top to move between the folded position and the unfolded position;

wherein the engaging portion of the first lip is at least partially disposed in the receiving portion of the second lip when the table top is in the folded position; and wherein the engaging portion of the first lip is spaced apart and separated from the receiving portion of the second lip when the table top is in the unfolded position.

16. The folding table top as in claim 15, wherein the first lip has a generally L-shaped configuration and the second lip has a generally L-shaped configuration; and wherein the first lip and the second lip nest together when the table top is in the folded position.

17. The folding table top as in claim 15, wherein the first lip has a first height and the second lip has a second height; and wherein a total height of the first lip and the second when the table is in the folded position is at least about fifteen percent smaller than the height of the first lip and the height of the second lip.

18. The folding table top as in claim 17, wherein the first lip and the second lip have generally the same size, shape and configuration;

wherein the first lip and the second lip are generally aligned and coplanar; and wherein the first lip and the second lip have an inverted position relative to a lower surface of the table top to allow the engaging portion to be disposed in the receiving portion when the table is in the folded position.

19. The folding table top as in claim 15, further comprising a frame including a first portion connected to the first section of the table top and a second portion connected to the second section of the table top;

wherein the connecting member comprises a hinge assembly connecting the first portion of a frame and the second portion of the frame to allow the table top to be moved between the folded and the unfolded positions.

20. The folding table top as in claim 15, further comprising:

a first support structure connected to the first section of the table top, the first support structure movable between an extended position in which the first support structure extends outwardly from the first section of the table top and a collapsed position in which the first support structure is disposed generally parallel and at least proximate the first section of the table top; and a second support structure connected to the second section of the table top, the second support structure movable between an extended position in which the second support structure extends outwardly from the second section of the table top and a collapsed position in which the second support structure is disposed generally parallel and at least proximate the second section of the table top.

* * * * *

UNITED STATES PATENT AND TRADEMARK OFFICE

CERTIFICATE OF CORRECTION

PATENT NO. : 9,192,230 B2
APPLICATION NO. : 14/283191
DATED : November 24, 2015
INVENTOR(S) : Clegg et al.

It is certified that error appears in the above-identified patent and that said Letters Patent is hereby corrected as shown below:

IN THE SPECIFICATION

In Column 8, Line 31, delete “is rear” and insert -- is a rear --, therefor.

In Column 8, Line 32, delete “is left” and insert -- is a left --, therefor.

In Column 17, Line 1, delete “upper surface 16” and insert -- upper surface 14 --, therefor.

In Column 20, Lines 22-23, delete “engaging portion 90” and insert -- engaging portion 88 --, therefor.

In Column 20, Line 29, delete “engaging portion 90,” and insert -- engaging portion 88, --, therefor.

Signed and Sealed this
Fifth Day of April, 2016

Michelle K. Lee

Michelle K. Lee
*Director of the United States Patent and Trademark Office*